US006694869B2

(12) United States Patent
Sutton et al.

(10) Patent No.: US 6,694,869 B2
(45) Date of Patent: Feb. 24, 2004

(54) VERTICAL BALER USING ELONGATED BEAM COMPRESSION CONSTRUCTION

(75) Inventors: Gregory Bryan Sutton, Perry, GA (US); Dennis E. Finegan, Green Cove Springs, FL (US); Mark E. Lindsey, Jacksonville, FL (US)

(73) Assignee: Load King Manufacturing Co., Jacksonville, FL (US)

( * ) Notice: Subject to any disclaimer, the term of this patent is extended or adjusted under 35 U.S.C. 154(b) by 0 days.

(21) Appl. No.: 09/992,547

(22) Filed: Nov. 13, 2001

(65) Prior Publication Data

US 2002/0148366 A1 Oct. 17, 2002

Related U.S. Application Data

(63) Continuation-in-part of application No. 09/496,830, filed on Feb. 2, 2000, now Pat. No. 6,474,226.

(51) Int. Cl.[7] ..... B65B 13/18
(52) U.S. Cl. ..... 100/34; 100/3; 100/218
(58) Field of Search ..... 100/3, 34, 218, 100/255, 269.11, 269.13, 45, 49, 349, 352, 345

(56) References Cited

U.S. PATENT DOCUMENTS

| | | | | | |
|---|---|---|---|---|---|
| 705,134 | A | * | 7/1902 | Pope et al. | 100/3 |
| 1,142,188 | A | * | 6/1915 | Macomber | 100/34 |
| 3,195,447 | A | * | 7/1965 | Taylor | 100/218 |
| 3,469,530 | A | * | 9/1969 | Walker et al. | 100/218 |
| 3,728,959 | A | * | 4/1973 | Fredrickson | 100/218 |
| 3,762,312 | A | * | 10/1973 | Guhl | 100/255 |
| 3,855,919 | A | * | 12/1974 | Potter | 100/218 |
| 3,861,296 | A | * | 1/1975 | Clar | 100/229 A |
| 3,911,807 | A | * | 10/1975 | Birnbaum | 100/218 |
| 4,057,009 | A | * | 11/1977 | Burford et al. | 100/218 |
| 4,182,236 | A | * | 1/1980 | Greer | 100/218 |
| 4,232,599 | A | * | 11/1980 | Ulrich | 100/218 |
| 4,273,037 | A | * | 6/1981 | Ruebesam | 100/229 A |
| 4,311,092 | A | * | 1/1982 | Tea | 100/255 |
| 4,541,332 | A | * | 9/1985 | Horansky et al. | 100/3 |
| 5,044,271 | A | * | 9/1991 | Robbins et al. | 100/218 |
| 5,575,199 | A | * | 11/1996 | Yamamoto | 100/34 |
| 5,632,199 | A | * | 5/1997 | Molitorisz et al. | 100/218 |
| 6,367,377 | B1 | * | 4/2002 | Gawley et al. | 100/49 |

* cited by examiner

*Primary Examiner*—Stephen F. Gerrity
(74) *Attorney, Agent, or Firm*—Allen, Dyer, Doppelt, Milbrath & Gilchrist, P.A.

(57) ABSTRACT

A vertical baler includes a horizontally disposed floor plate having an arched surface for receiving material to be compacted thereon. A compression plate is mounted for reciprocating vertical movement with respect to the floor plate, and left and right hydraulic pistons carried outside the wall of the baler are operably attached between the floor plate and the compression plate for reciprocating the compression plate relative to the floor plate. Material placed between the arched floor plate and the compression plate is compacted and formed with an arched bottom surface for ease in sliding fork elements of a lift truck thereunder. Once compacted and tied, the bale is pushed from the compaction chamber by pusher tabs vertically extending from a rear edge of the floor plate which is operable for horizontal reciprocation causing biasing of the pusher tabs against the material in a horizontal pushing of the bale from the chamber onto an adjacent floor surface. To enhance formation of the bale having a desired arched bottom shape, struts are carried on a top surface of the floor plate for forming a depression within the bale formed during the compression of the material. Yet further shaping of the bale is provided by a pair of opposing struts extending along opposing edges of the compression plate, for providing enhanced compression of the material along lower opposing edge portions of the floor plate.

34 Claims, 22 Drawing Sheets

VERTICAL BALER USING ELONGATED BEAM COMPRESSION CONSTRUCTION

CROSS-REFERENCE TO RELATED APPLICATIONS

This application is a continuation-in-part of and incorporates by reference co-pending application Ser. No. 09/496,830, filed Feb. 2, 2000 now U.S. Pat. No. 6,474,226, commonly owned with the present application.

FIELD OF THE INVENTION

The present invention relates to apparatus and methods for compacting and baling waste materials such as paper and cardboard.

BACKGROUND OF THE INVENTION

Both horizontal and vertical baling machines are well known in the art. Overhead ceiling limitations often make a horizontal baler attractive for use, yet added floor space is needed when compared to a vertical baler. Typically, a vertical baler will eject the bale by rolling or flipping the bale onto adjacent floor space making it hazardous for an operator standing near the baler. A horizontal baler pushes the bale from a compaction chamber at a level above the floor in order to locate a lift truck for receiving the bale. It would be desirable to push bales onto the floor directly, but difficulty arises when an operator attempts to move the bale for placing the lift forks, making safety an issue. With further regard to safe operation, an operator must take care to stand clear of the compaction chamber when a gate is opened for depositing waste material to be compacted.

SUMMARY OF THE INVENTION

Among the objects of the present invention is the provision of a baler that addresses the needs of minimal floor and vertical space requirements relative to bale size, and provides a bale shape that is effectively handled by available handling equipment such as fork lifts and lift trucks, while providing for safe operation of the baler by an operator.

These and other objects, advantages and features of the present invention are provided by a baling apparatus having a horizontally disposed base with an arched floor plate for receiving material to be compacted thereon. A compression plate assembly is mounted for reciprocating vertical movement with respect to the floor plate, and reciprocating means are operably attached between the horizontally disposed floor plate and the compression plate assembly for reciprocating the compression plate relative to the floor plate, wherein material placed between the arched floor plate and the compression plate assembly is compacted with an arched bottom surface. Pusher means vertically extend from an edge of the floor plate, which is operable for horizontal reciprocation, causing biasing of the pusher tabs against the material in a horizontal pushing movement, wherein material compacted between the compression plate assembly and the floor plate is pushed from the chamber onto an adjacent support surface.

To enhance formation of a bale having a desired arched bottom, at least one elongate depression member is carried on a top surface of the floor plate for forming a depression within the bale during the compacting of the material. Two depression members spaced for enhancing slidable movement of a fork lift under a bale formed by the apparatus may be employed. An alternate embodiment includes pusher tabs extending from rear edges of the strut.

Other aspects of the present invention include the steps of horizontally disposing the floor plate onto a base for providing a closed bottom end of the chamber, wherein the floor plate comprises the arched top surface for forming an arched bottom in the compacted material. Material to be compressed is loaded into the chamber and is compressed by reciprocating the compression plate assembly in the chamber.

In preferred forms of the present invention, the compacting and baling apparatus employs construction features for the compression plate assembly, floor plate assembly and associated compression means which provide the necessary structural integrity to withstand the pressures and mechanical stresses arising during operation, yet providing a relatively lightweight construction with a small floor space "footprint" and which may be fitted into an area having limited ceiling heights. Among the construction features which achieve these goals are the utilization of compression means in the form of vertically-extending piston assemblies that fit within the compact horizontal and vertical configuration of the apparatus. Other construction features and methods of the baler system of the present invention are depicted in the drawings, and disclosed in the following detailed description and claims.

BRIEF DESCRIPTION OF THE DRAWINGS

A preferred embodiment of the invention, as well as alternate embodiments are described by way of example with reference to the accompanying drawings in which.

DETAILED DESCRIPTION OF PREFERRED EMBODIMENTS

The present invention will now be described with reference to the accompanying drawings, in which preferred embodiments of the invention are shown. This invention may, however, be embodied in many different forms and should not be construed as limited to the embodiments set forth herein.

Figure 1:
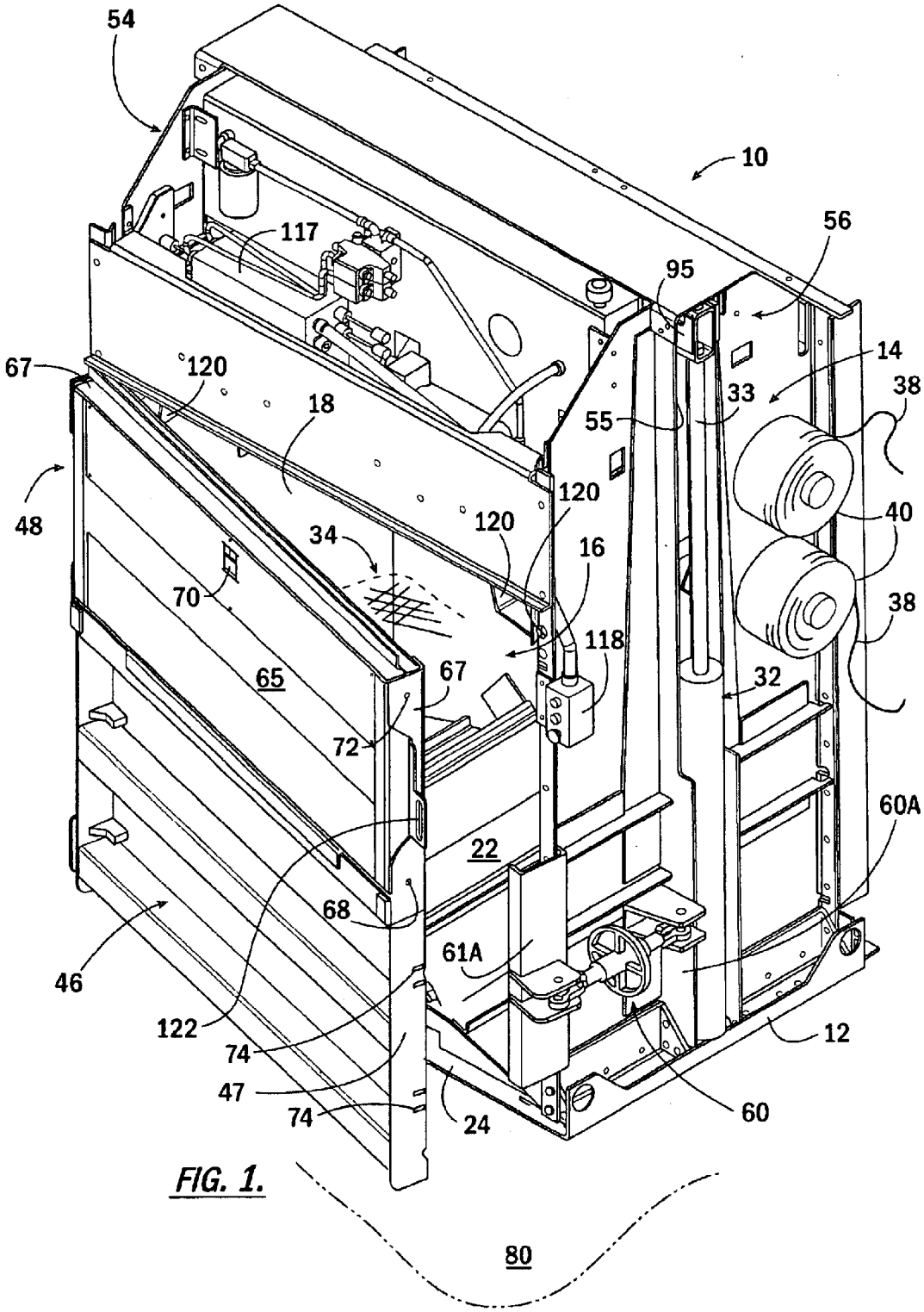
FIG. 1 is a perspective view of the baling apparatus of the present invention, illustrated with a top cover removed for viewing hydraulics and controls electronics carried within a top portion thereof.
Figure 2:
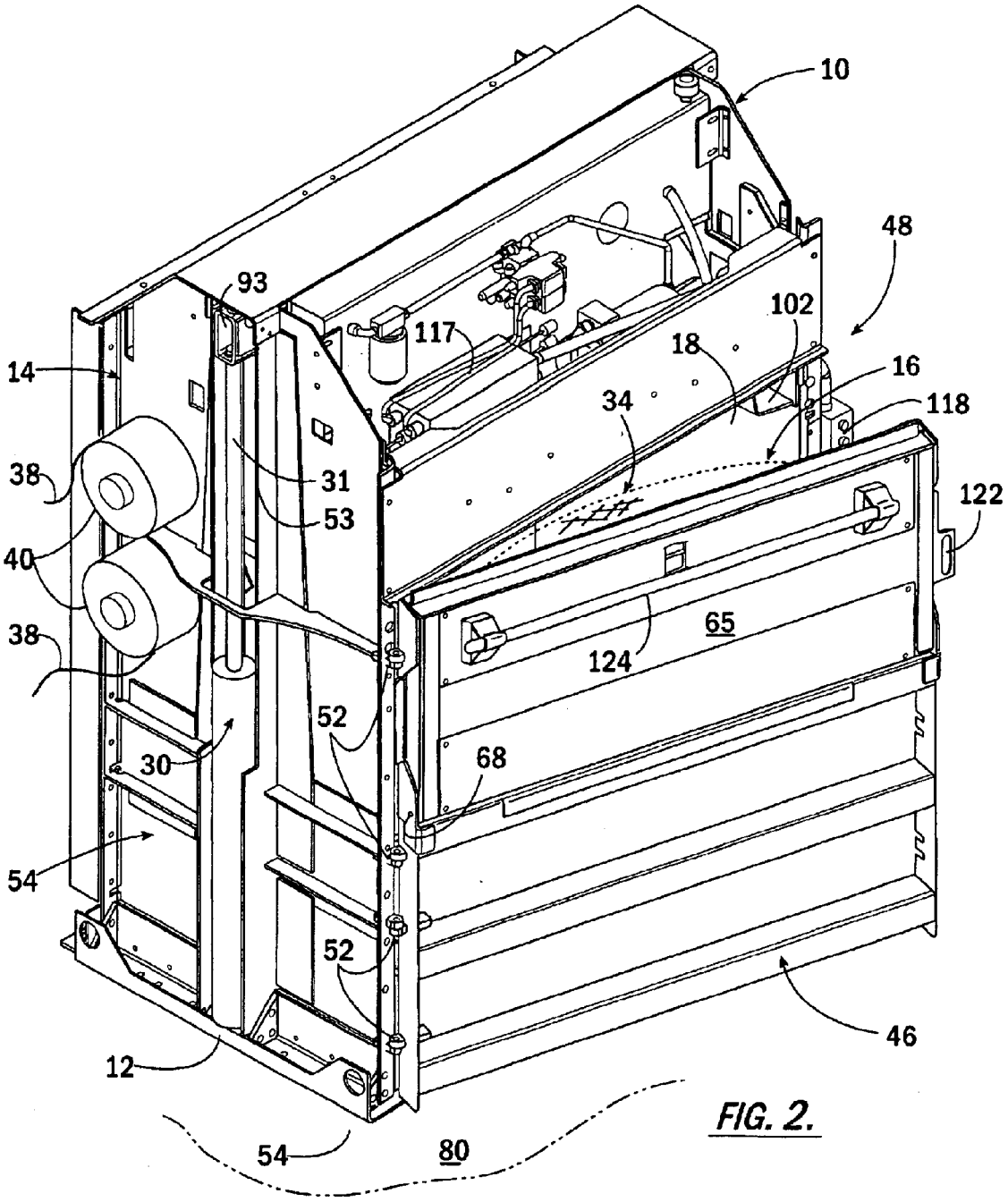
FIG. 2 is a left front perspective view of FIG. 1, illustrating the door in an open position.
Figure 3:
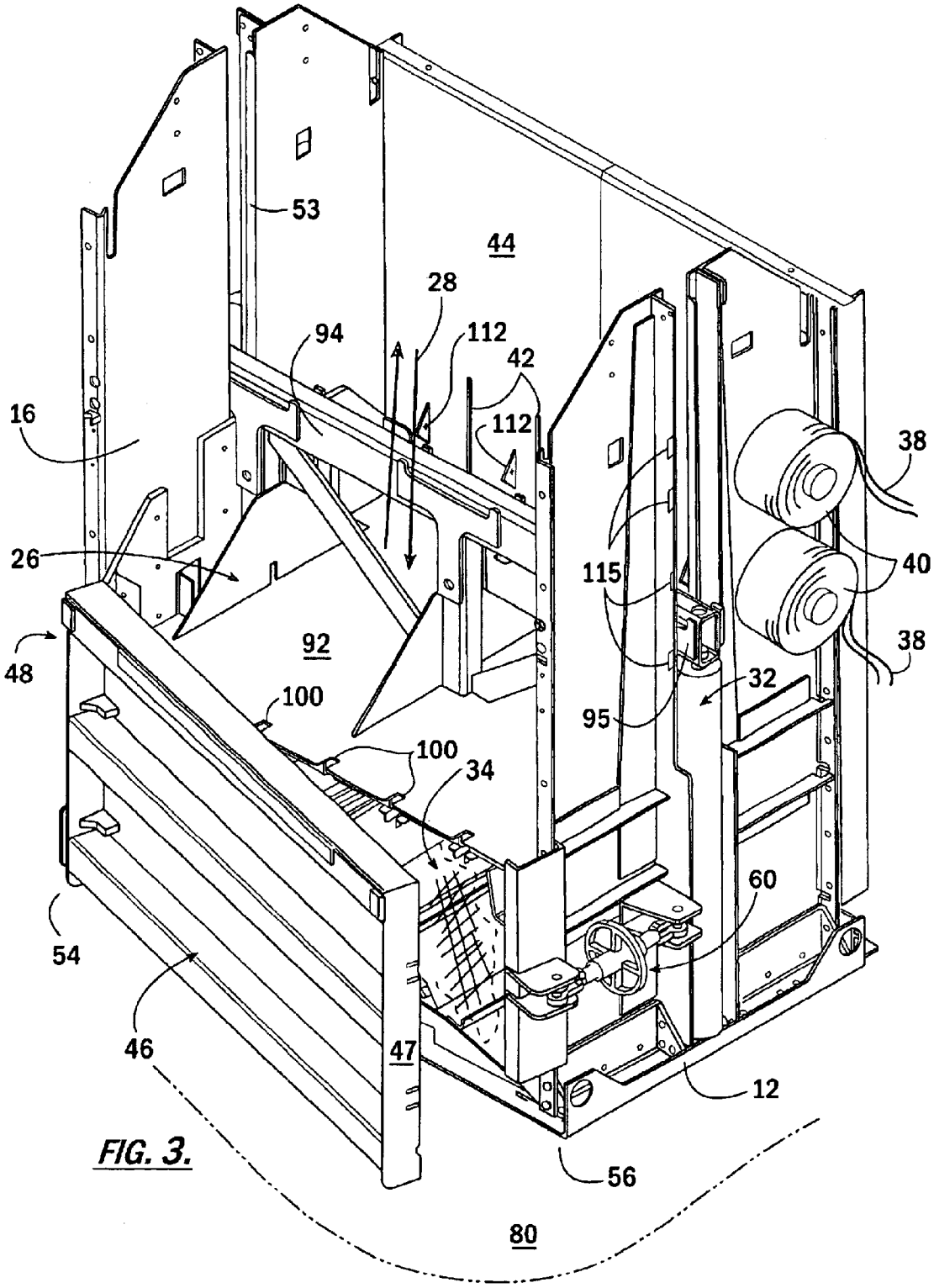
FIG. 3 is a partial perspective view of the apparatus of FIG. 1 illustrating the compacting position of the compression plate.

With reference initially to the perspective views of FIGS. 1, 2 and 3, the baling apparatus 10 of the present invention comprises a base 12 and a pair of opposing walls 14 and 54 extending vertically upward from the base 12 for defining with the base 12 a compaction chamber 16 having a chamber top 18. A horizontally disposed floor plate 20 having an arched top surface 22 is fixedly attached to the base 12 for providing a closed bottom 24 of the chamber 16. A compression plate 26 is mounted above the base 12 for reciprocating movement within the chamber 16 toward and away from the base 12 as depicted by arrows 28. Left and right hydraulic piston assemblies 30, 32 carried outside the wall 14 employ respective extensible and retractable piston arms 31, 33 coupled to opposite sides of the plate 26 to provide means for reciprocating the compression plate 26 relative to the chamber 16, toward and away from the floor plate 20, such that waste material 34 loaded into the chamber 16 is compacted between the compression plate and the floor plate while confined within the vertically extending wall 14. Each of the hydraulic piston assemblies 30, 32 is operably connected between the base 12 and the compression plate 26, which plate will be further detailed later in this section.

Figure 2A:
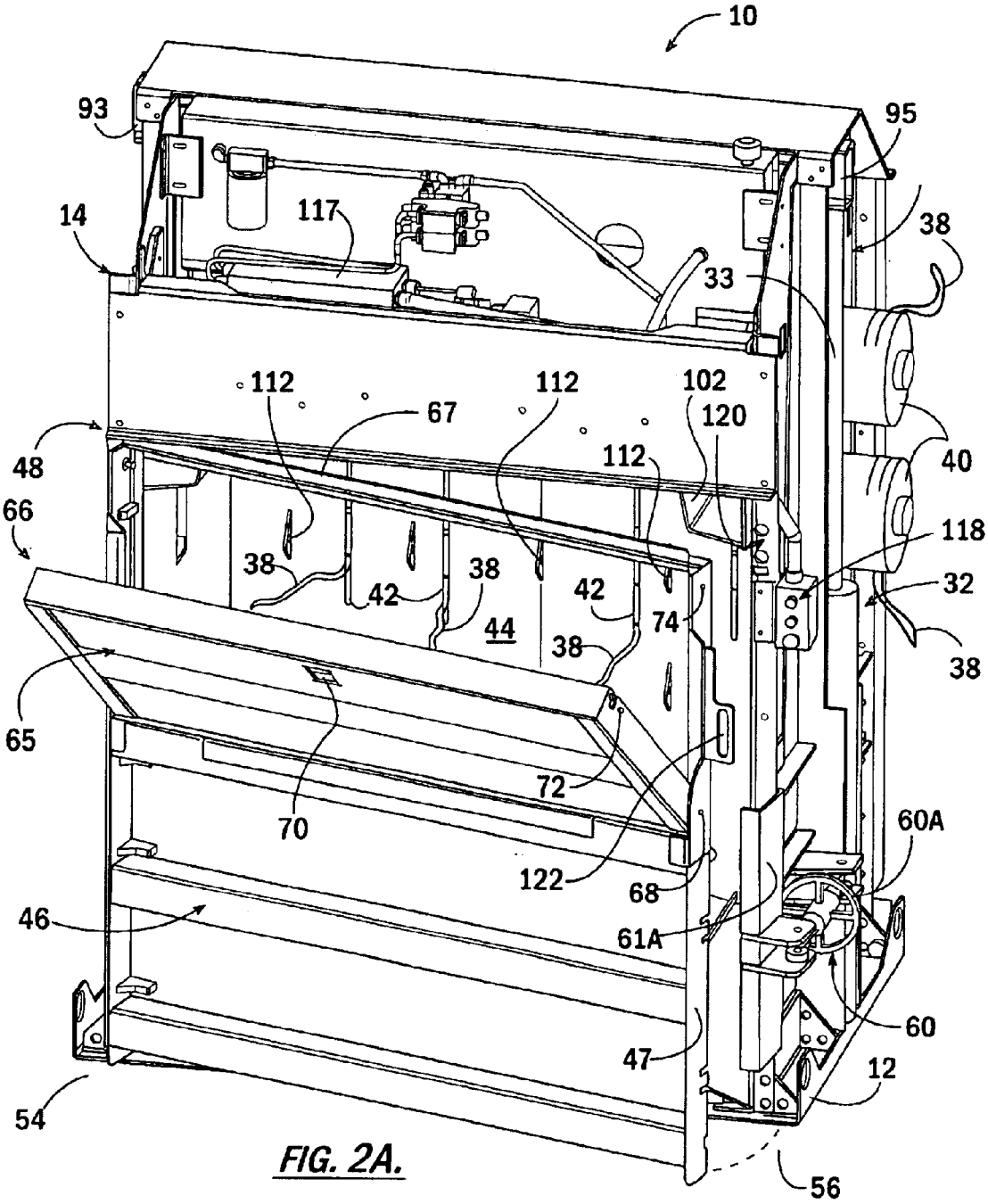
FIG. 2A is a front right perspective view of the embodiment of FIG. 1 illustrating the feed gate in an open position.
Figure 4:
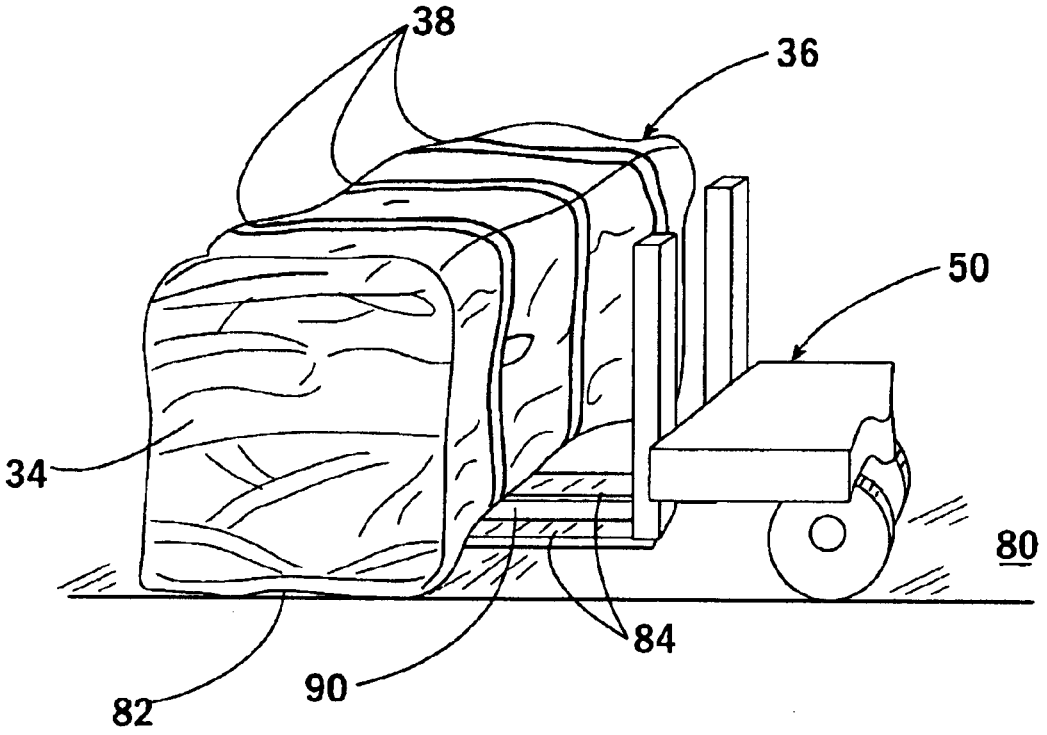
FIG. 4 is a perspective view of a bale prepared using the apparatus of the present invention.

For the apparatus 10, baling of the compacted waste material 34 is completed for providing a bale 36 as illustrated in FIG. 4. In one embodiment, strapping means is provided by strapping 38 stored on reels 40 for manually feeding through slots 42 within a rear wall section 44, as illustrated in FIG. 2A, and placed over the floor plate 20 prior to loading of waste material into the chamber 16. After compaction of the waste material 34, a chamber door 46, located on a front wall 48, is opened and the compacted waste material 34 tied after manually feeding the strapping 38 around the waste material and while the compression plate 26 maintains compaction of the material. After the waste material 34 is tied and the fabrication of the bale 36 completed, pressure on the waste material is released and the bale is then pushed from the chamber 16 for handling by a lift truck 50. Various strapping and tying methods and materials, well known in the art, may be used in completing the tying of the bale.

Figure 1A:
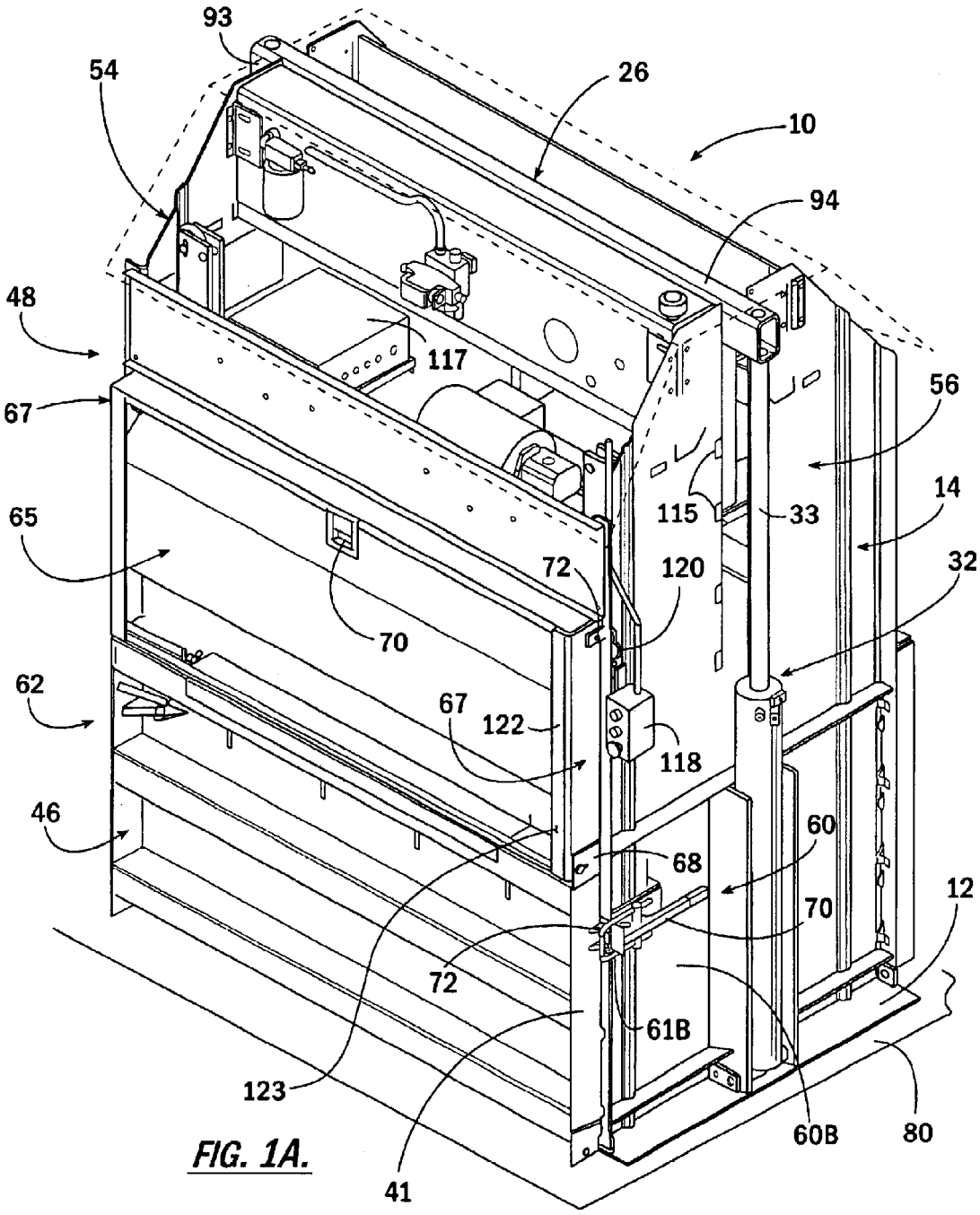
FIG. 1A is the embodiment of FIG. 1 illustrating a closed operable position.
Figure 5:
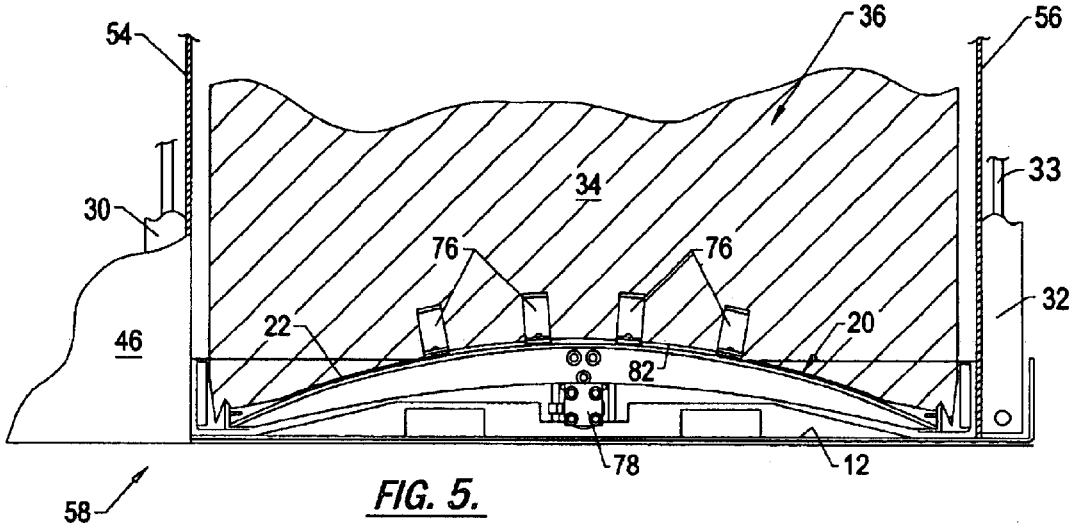
FIG. 5 is a partial front elevation view of the apparatus of FIG. 1 in a door open position illustrating exposure of the floor plate carrying waste material.

As illustrated in FIGS. 1A, 2, and 2A, the chamber door 46 forms a portion of the front wall 48 of the wall 14. The chamber door 46 is pivotally secured using hinges 52 attached along the left side wall 54, and is latched at the side wall 14 at section 56, as herein described. The chamber door 46 provides access to the chamber 16 for exposing the compacted waste material 34 compressed onto the arched top surface 22 of the floor plate 20 for slidable movement of the waste material from the chamber when the chamber door is in an open position 58, as illustrated in FIG. 5.

Figure 6:
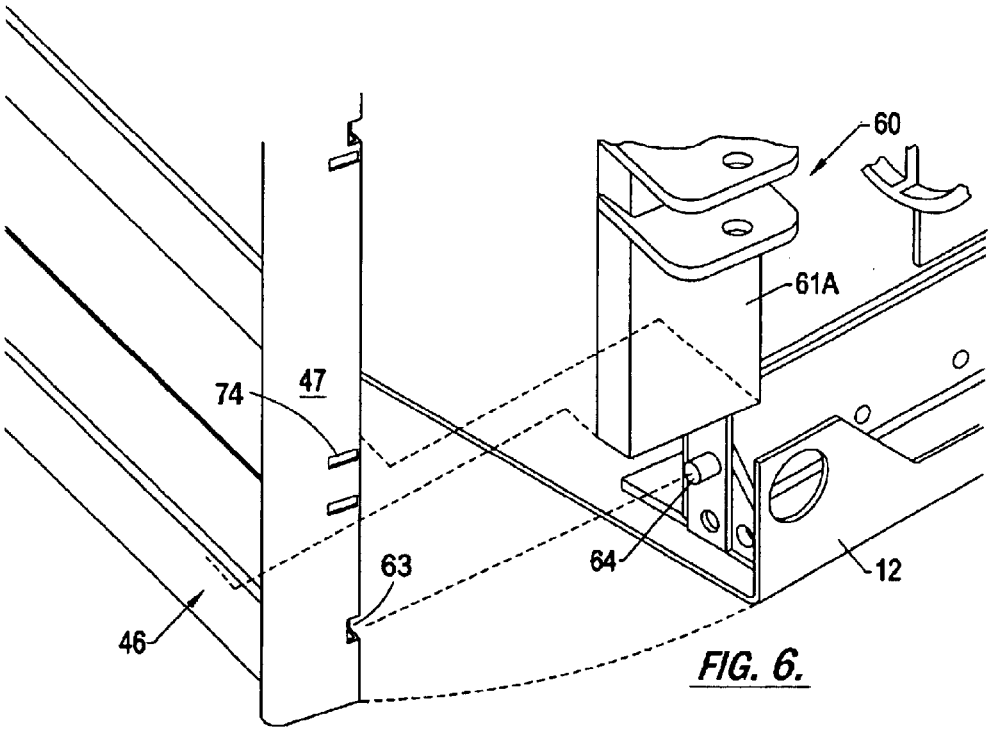
FIG. 6 is a partial perspective view of locking pins operable with the chamber door.
Figure 7:
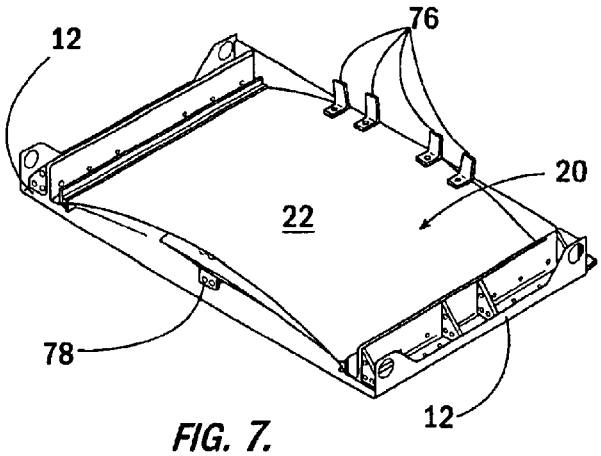
FIGS. 7 and 8 are partial perspective and top plan views of the floor plate of FIG. 5.
Figure 8:
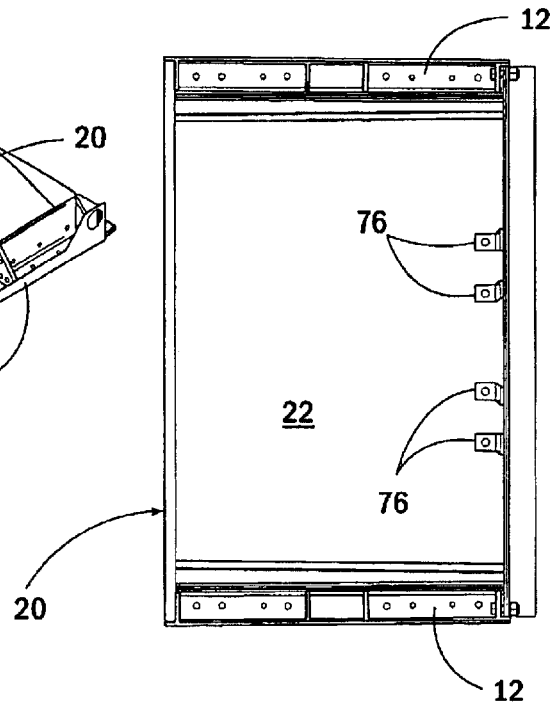
Figure 9:
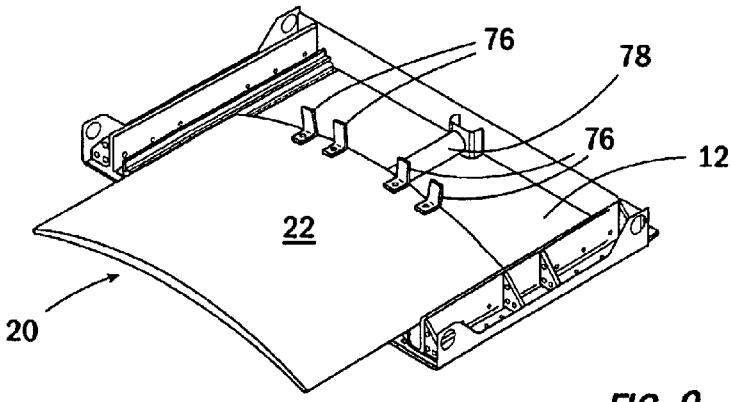
FIG. 9 is a partial perspective view of the floor plate of FIG. 7 is a displaced position.

As illustrated with reference again to FIGS. 1 and 1A, a door latch 60 secures the door 46 in a closed position 62. Alternate embodiments of the door latch 60 include the wheel styled latch 60A illustrated in FIG. 1, and the lever arm styled latch 60B illustrated in FIG. 1A. The wheel styled latch 60A shown in FIG. 1 includes a bracket 61A which is latched to an edge portion 47 of the door 46, with the wheel rotated to secure the door 46 in the closed position 62. The latch 60B shown in FIG. 1B includes a pivotal lever arm and clamp 61B to secure the door 46 in the closed position. As shown in FIG. 6, to further secure the chamber door 46, locking pins 64 are fixedly attached to the edge of the right side wall section 56 for mating with slots 63 carried within the door 46 for a locking engagement of the chamber door 46 with the right wall section 56.

As shown in FIGS. 1 and 1A, the baling apparatus 10 further comprises a feed gate 65 pivotally secured using spring loaded pins 68 within a frame 67 integrally formed with the chamber door 46 and attached with bottom frame 47. The feed gate 65 provides access to the chamber 16 above the chamber door 46 and through an opening of the frame 67 for loading the waste material 34 into the chamber when the feed gate is in an open position 66 (FIG. 2A) and the door in the closed position 62 (FIG. 1A). By pivoting about horizontally aligned hinge pins 68, the feed gate 65 acts as a slide for loading the waste material 34 and serves to keep an operator distanced from the compaction chamber 16 and compression plate 26, providing safety to the operation of the baling apparatus 10. In addition, the feed gate 65 and the chamber door 46 can be simultaneously opened through the hinged action of the frame 67, as illustrated in FIG. 1. A gate latch 70 is operable for insertion and removal of latch pins 72 into holes 74 carried within the frame 67.

Figure 10:
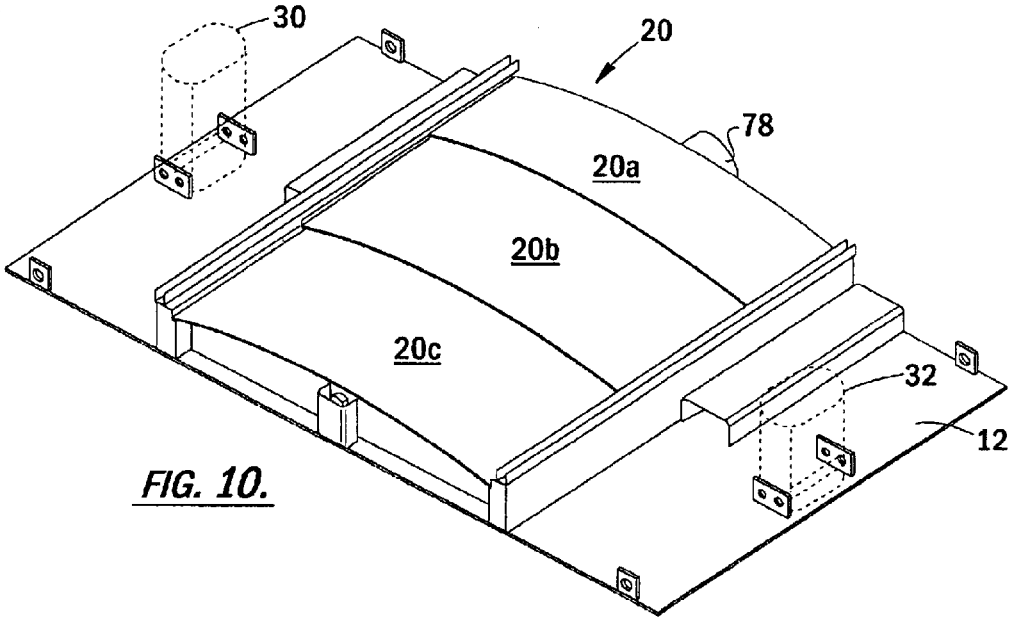
FIGS. 10 and 11 are partial perspective and front elevation views of an alternate telescoping floor plate construction.
Figure 11:
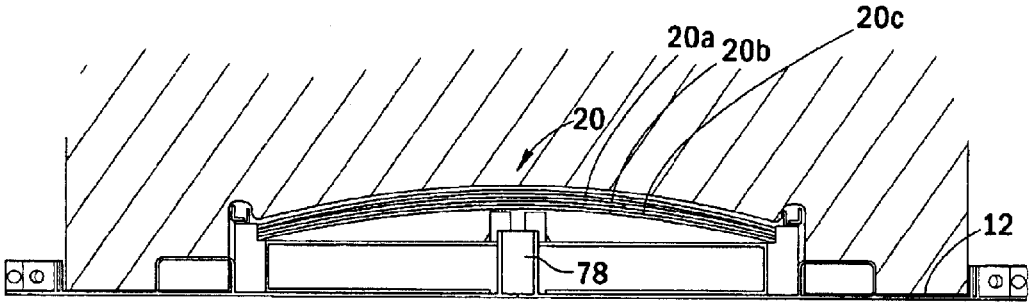

As illustrated in FIGS. 5 and 7–9, pusher tabs 76 are attached to a rear edge of the floor plate 20 and extend vertically to cradle the waste material 34 deposited onto the floor plate. The floor plate 20 is reciprocated by a floor plate piston assembly 78 for horizontal movement out of and into the chamber 16 when the chamber door 46 is in the open position 58, wherein the bale 36 formed from the compacted waste material 34 is pushed from the chamber 16. The pusher tabs 76 bias against an edge of the bale 36 in a pushing movement, while the floor plate slides back into the chamber 16 in the retracting movement, after depositing the bale onto a support surface 80 (i.e., FIG. 4) adjacent the apparatus 10, as the retracting bale makes contact with the wall 14 and the support surface 80, allowing the bale to slide off of the floor plate 20 as the plate is retracted. In an alternate embodiment, and as shown in FIGS. 10 and 11, the floor plate 20 comprises a plurality of telescoping plate sections 20*a*, 20*b*, 20*c*. In yet another embodiment, which is not illustrated in the drawing, the bale 36, tied and ready for removal from the chamber 16, is removed therefrom using the lift truck 50, after the left and right side walls 14, 54 are outwardly hinged from the rear wall section 44 to allow the fork elements 84 to contact the bale after the side walls are removed. The bale 36 is then removed using the fork elements 84 without the need to push the bale from the chamber 16.

Figure 3A:
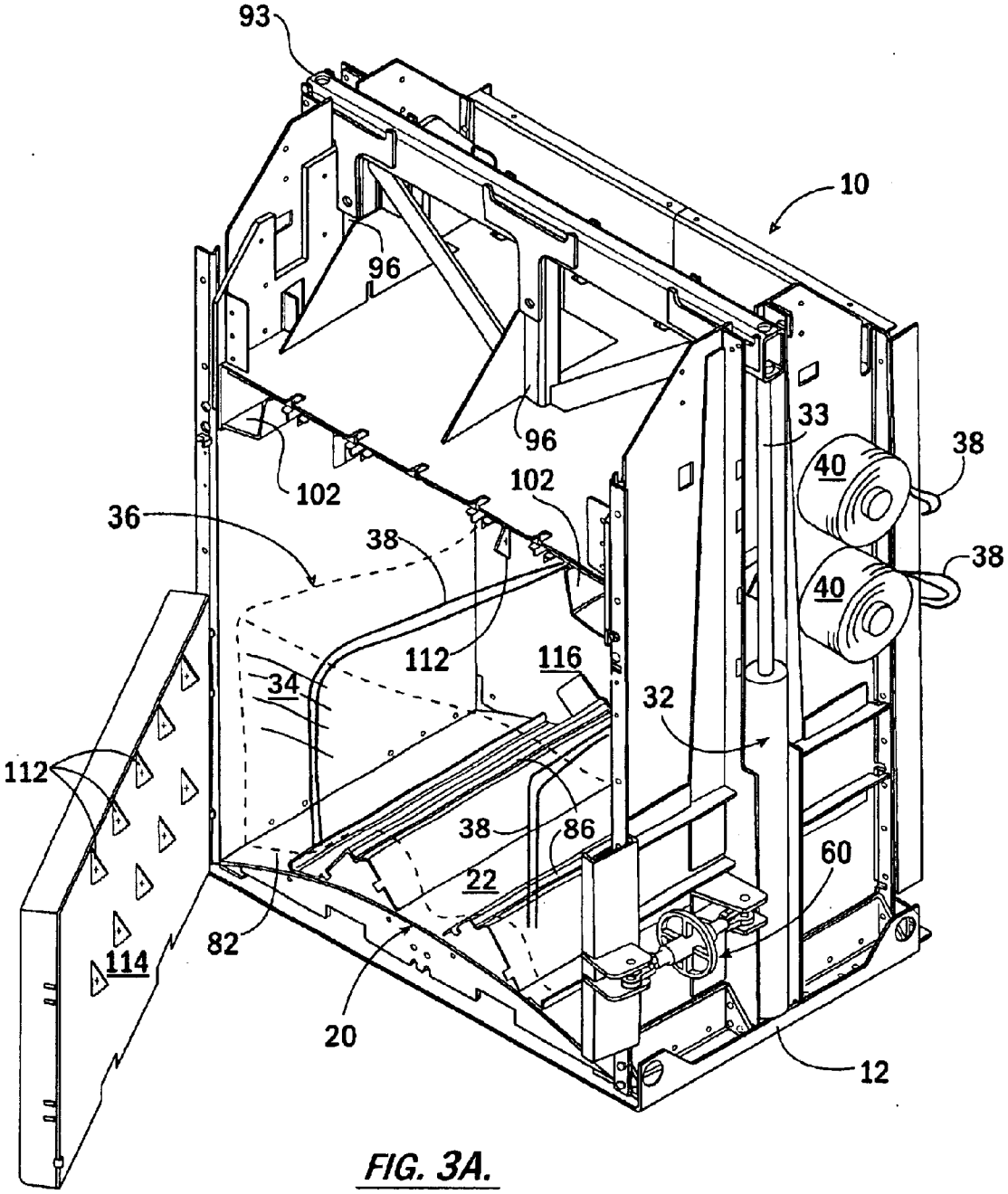
FIG. 3A is a partial perspective view of FIG. 3 illustrating the compression plate in a raised position with the door opening for access to a bale.

As illustrated in FIGS. 4 and 5, the arched top surface 22 of the floor plate 20 causes a desired arched bottom 82 of the bale 36 allowing fork elements 84 of the lift truck to easily slide under the bale. Because of the variables in the compacting process and the variety of waste materials compacted, a bale can deform after compacting. As a result, there is a need to shape the bale 36 such that any deformation will not hamper the handling operation by the lift truck 50. An alternate embodiment of the present invention, as illustrated with reference to FIGS. 3A and 12, comprises a pair of elongate struts 86 carried on the arched top surface 22 of the floor plate 20 for forming depressions 88 within the bottom surface 82 of the bale 36 during the compression of the waste material 34. It is anticipated that a single strut 86, and various spacings between strut pairs will be useful depending on the type of waste material being compacted. The addition of the struts 86 has been shown to enhance the shaping of the bale 36 and the shape of the cavity 90 formed by the support surface 80 and the bale bottom surface 82 for providing ease in movement of the fork elements 84 under the bale 36.

Figure 12:
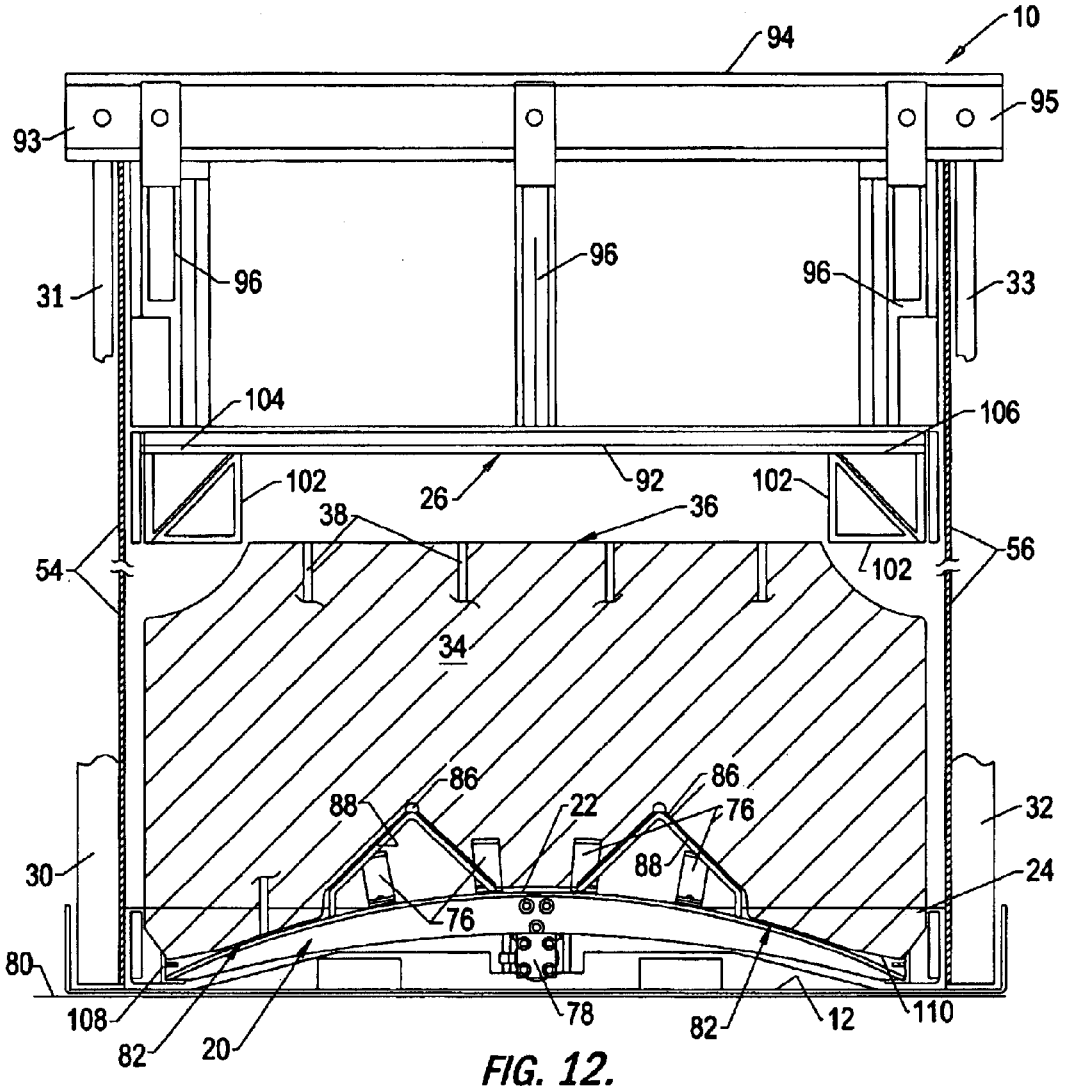
FIG. 12 is a partial front elevation view illustrating one compression plate and floor plate of the present invention.
Figure 13:
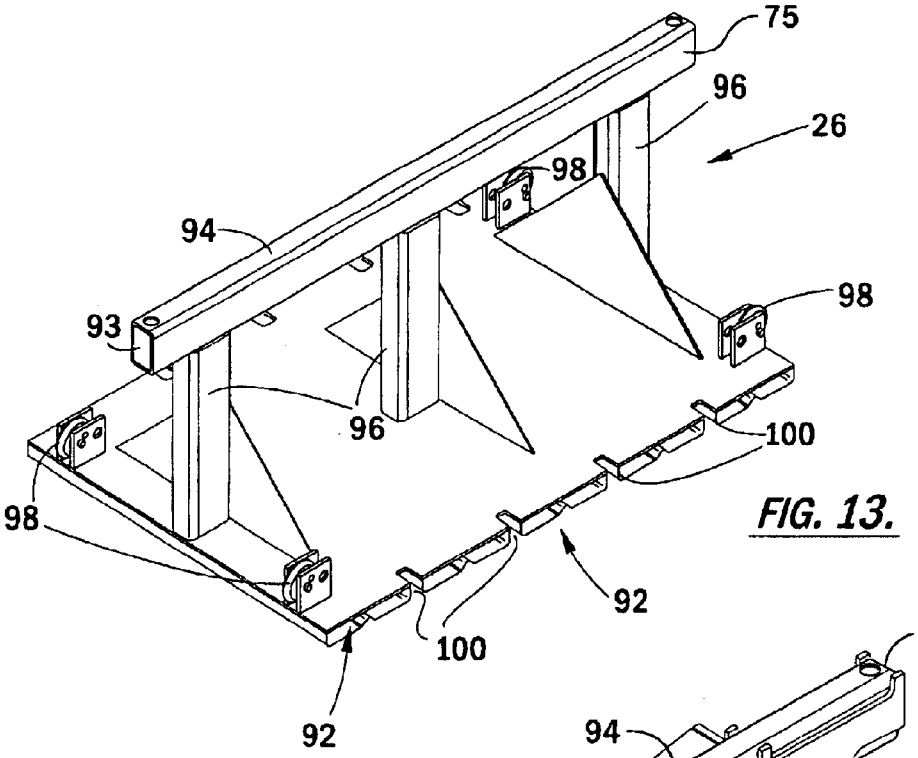
FIGS. 13 and 13A are partial perspective views of alternate compression plate embodiments.
Figure 13A:
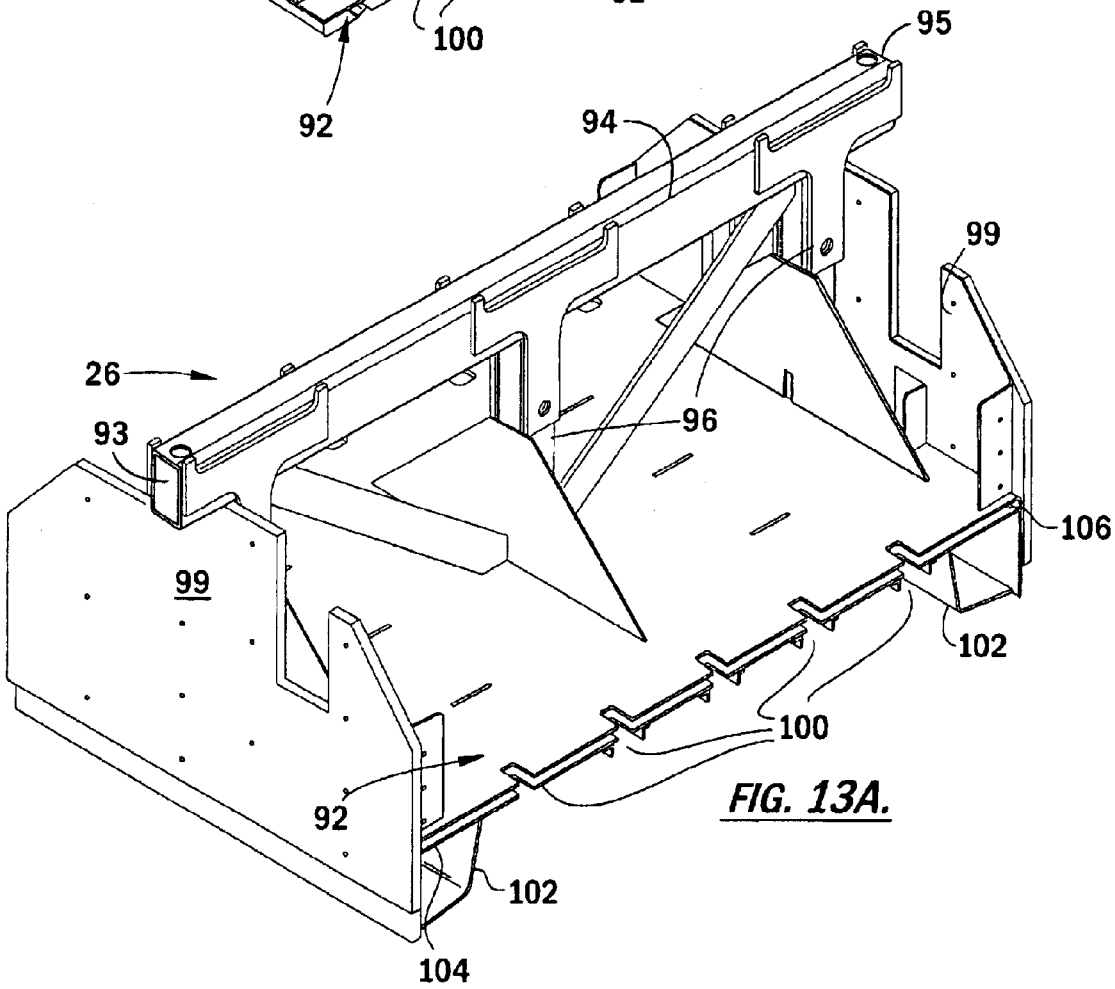

As illustrated in FIG. 3 and FIG. 12, the compression plate 26 comprises a plate member 92, and a beam 94 connected to the plate member by vertical support members 96 for securing the beam in a spaced and rigid relation to the plate member. Various lengths for the support elements 96 can be used to provide a desired displacement of the plate member 92 and thus the throw of the compression plate 26, further assuring the use of minimal floor space and height dimension needed for the apparatus 10. The opposing ends 93, 95 of the horizontally disposed beam 94 extend beyond the respective left and right side wall sections 54, 56 through corresponding vertically elongated slots 53, 55 therein for connection, respectively, to the corresponding piston 31, 33 of the left and right piston assemblies 30, 32 (FIG. 1). Guide elements in the form of wheels 98, and alternatively pads 99, as illustrated in FIGS. 13 and 13A, are carried at the edges of plate member 92 for slidable engagement with an inside surface of the left and right side wall sections 54, 56 during the reciprocating movement of the compression plate 26, and minimizing drift and friction between the plate 26 and inside wall surfaces. Slots 100 within the plate member 92 permit the strapping 38, earlier described, to be guided over the waste material for tying and forming the bale.

Now noting FIGS. 12 and 13A, to aid in the forming of the bale 36 and to provide a desired compression distribution onto the waste material 34, a pair of opposing top struts 102 extends along opposing left and right edges 104, 106 of the plate member 92 for cooperating with the arched surface 22 and the struts 86 in compressing the waste material. The pair of opposing top struts 102 enhance compression of the waste material along left and right side and lower portions 108, 110 of the arched floor plate 26. Noting FIG. 3A, tapered tabs 112 aligned with slots 100 and extend from front and rear inside wall surfaces 114, 116 of the chamber to enhance compaction by restricting upward expansion of the compressed waste material 34.

Figure 14:
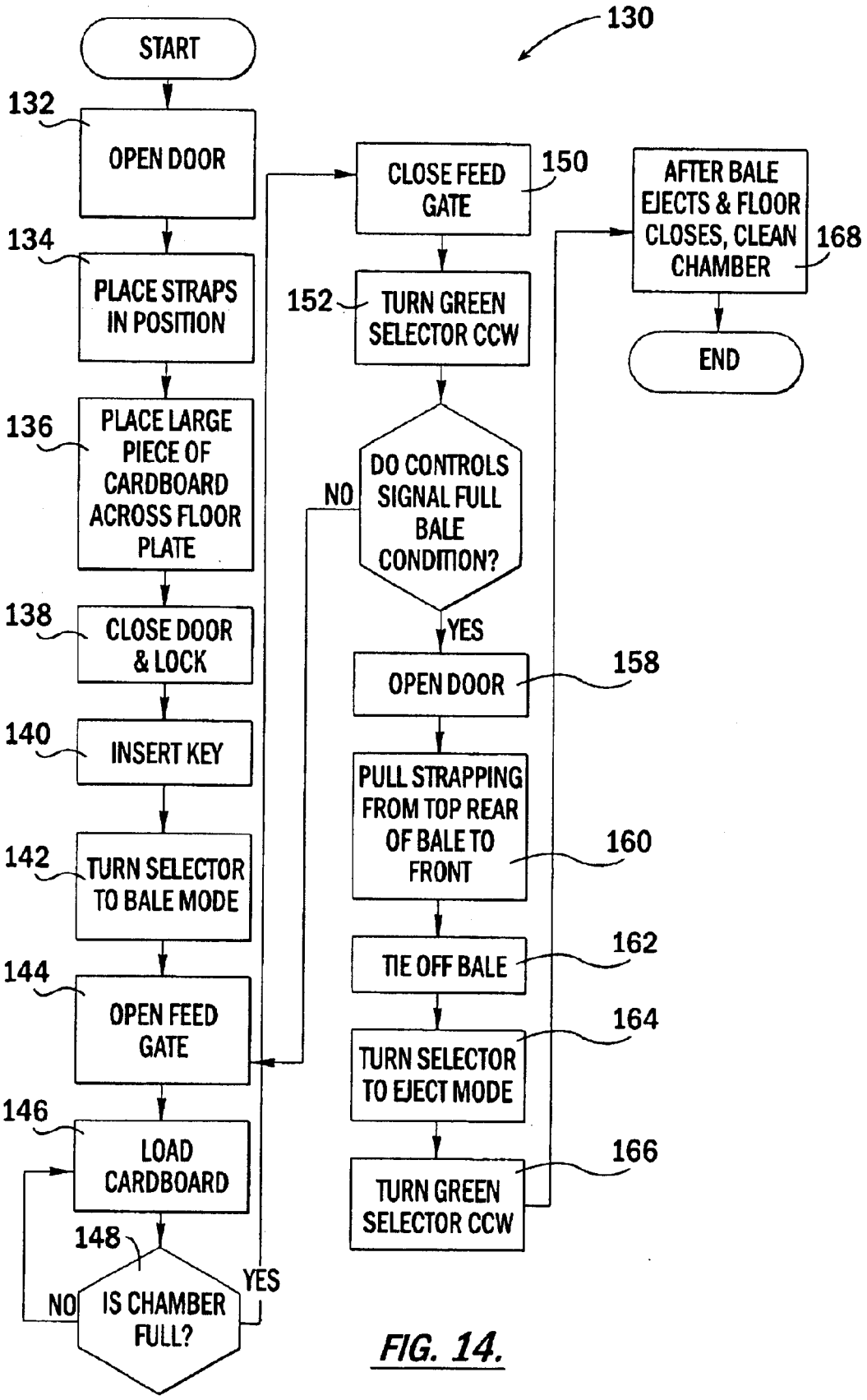
FIG. 14 is a flow diagram illustrating one operation of the baling apparatus.

The apparatus 10 provides for safe operation by an operator. As illustrated with reference to the flow chart of FIG. 14, one operating procedure, referred to generally as 130, includes the first step 132 of opening the chamber door 46 and then, at step 134, placing the strapping 38 for subsequent wrapping and tying of the compacted waste material 34. A preferred procedure, step 136, includes the placing of a sheet of cardboard onto the arched surface 22 of the floor plate for providing a uniform bale bottom surface 82. At step 138, the door 46 is then closed and secured in place using the door latch 60 as earlier described. For added safety, at step 140 a security key is used to select a baling mode of operation. As shown at steps 142 and 146, with the door 46 closed and latched, the feed gate 65 is opened and waste material loaded into the chamber 16 with the compression plate 26 in its fully retracted position above the chamber. Sensors 115 communicating with the controller 117 are operable with the plate 92 for detecting plate position and thus chamber capacity. When the chamber 16 is filled as desired as determined at steps 148, 150, the feed gate 65 is closed and, at step 152, the controller 117 operated by a keyed switch 118 initiates the compression process at step 156 by pulling of the compression plate 26 by the left and right piston assemblies 30, 32 if door and gate sensors 120 indicate a closed position at step 154. The location sensors 116 detect the position of the compression plate 26 to determine if a full bale condition exists. If a desired full bale is possible, the door 46 is opened at step 158 while the compression plate is in a compressing position, and the bale tied with the strapping 38 at step 162, after feeding the strapping around the waste material at step 160. The tied bale 36 is then ejected from the chamber by activating an eject mode using the keyed switch at steps 164, 166. The bale 36 is pushed from the chamber 16 as earlier described. Once ejected at step 168, the floor plate 20 is retracted back into the chamber 16, the door closed, and apparatus 10 is ready for operation in preparing another bale.

Safety is of primary concern as emphasized throughout the above description, including operation of the swinging out and downward opening of the gate to keep the operator distanced from potentially dangerous operable elements. Noting FIG. 1A, additional safety features include a handle 122 extending from the frame 67 and a textured frame corner 123 to discourage the operator from resting his hand on the gate. In yet another embodiment of the gate 65, as illustrated with reference again to FIG. 2, an elongate gate handle 124 is provided for raising and lowering the gate. The handle 124 is positioned to avoid pinching of operator hands by the gate edges.

Another version of a compacting and baling apparatus according to the present invention is shown in FIGS. 15–20, and described next.

Figure 15A:
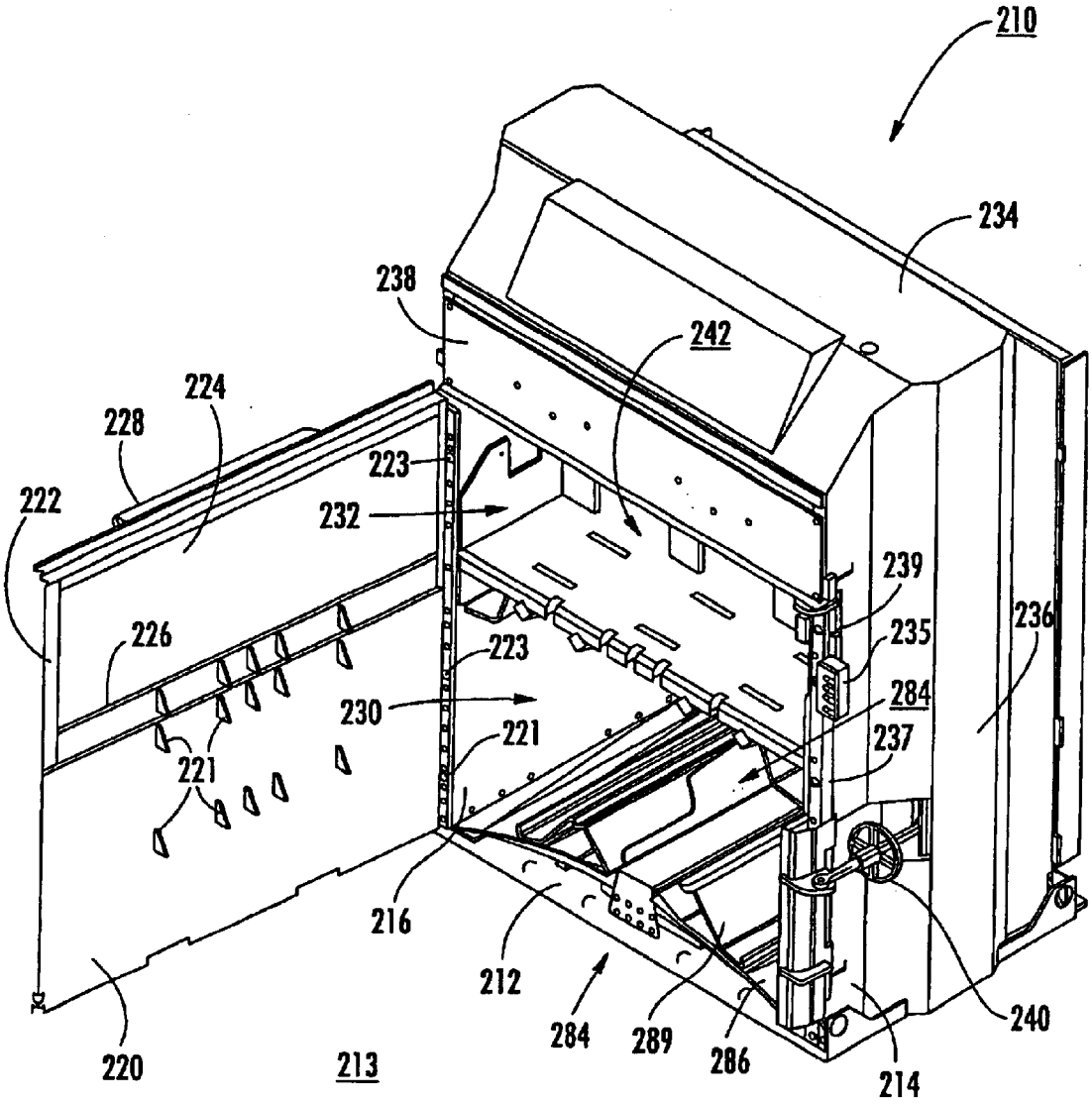
FIGS. 15A, 15B, 15C and 15D are front perspective, side, top and rear views, respectively, of another preferred embodiment of compacting and baling apparatus in accordance with the present invention.
Figure 15B:
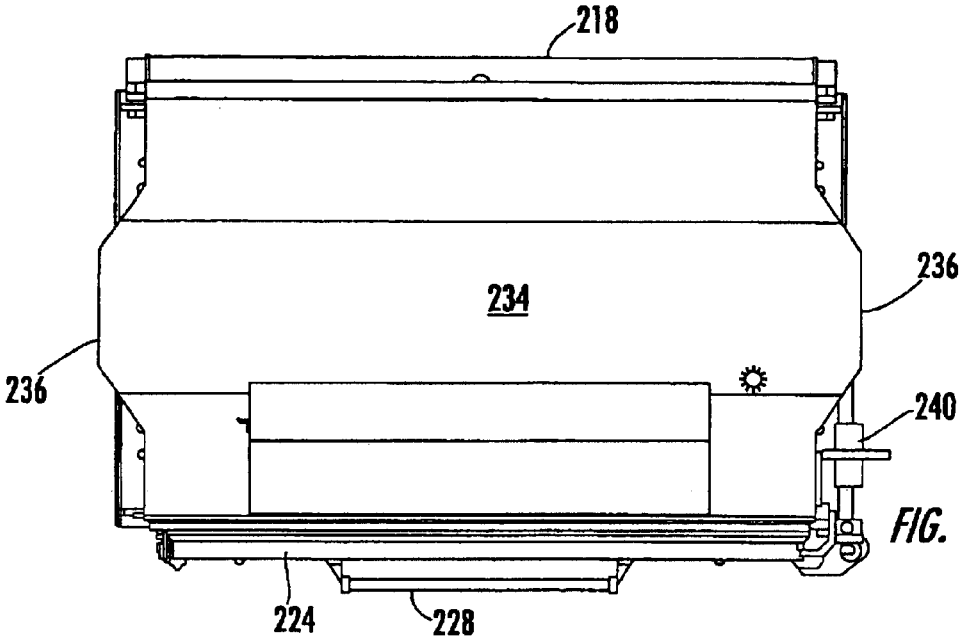
Figure 15C:
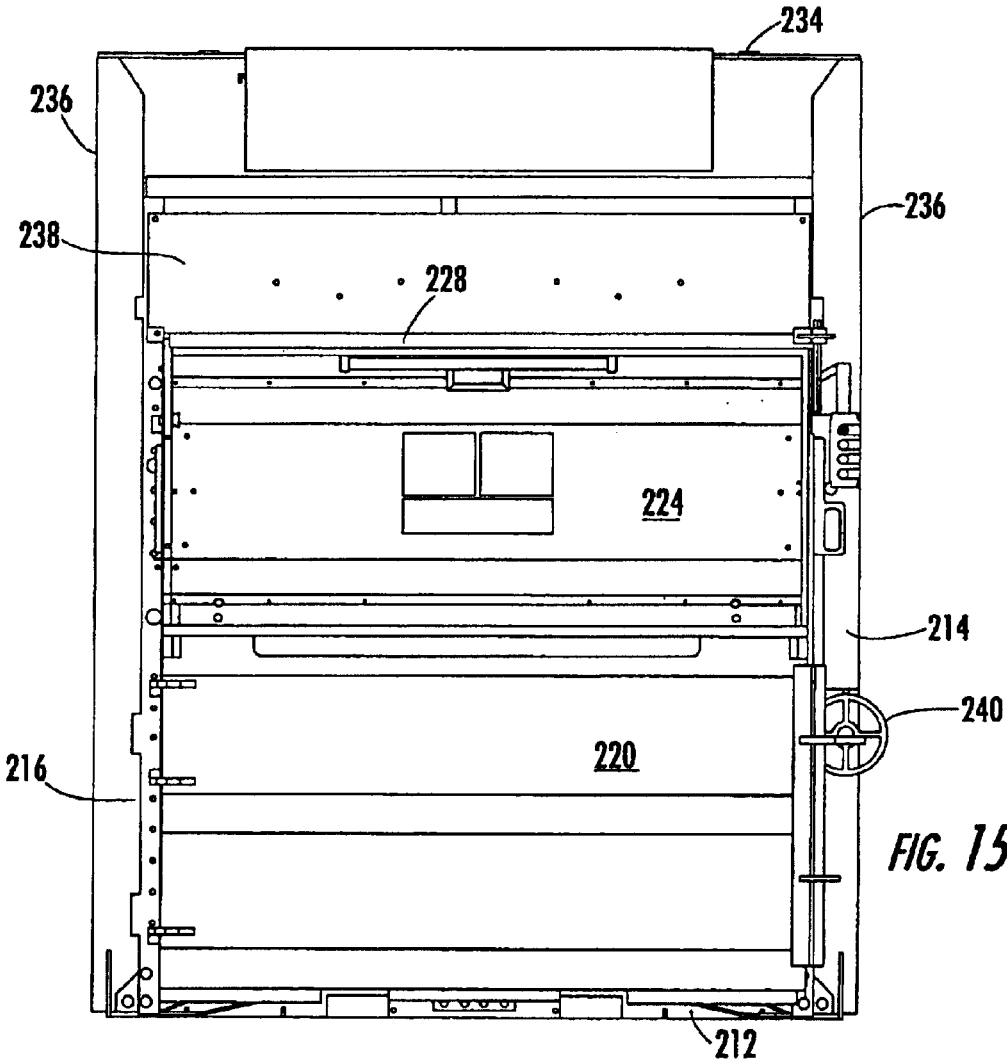
Figure 15D:
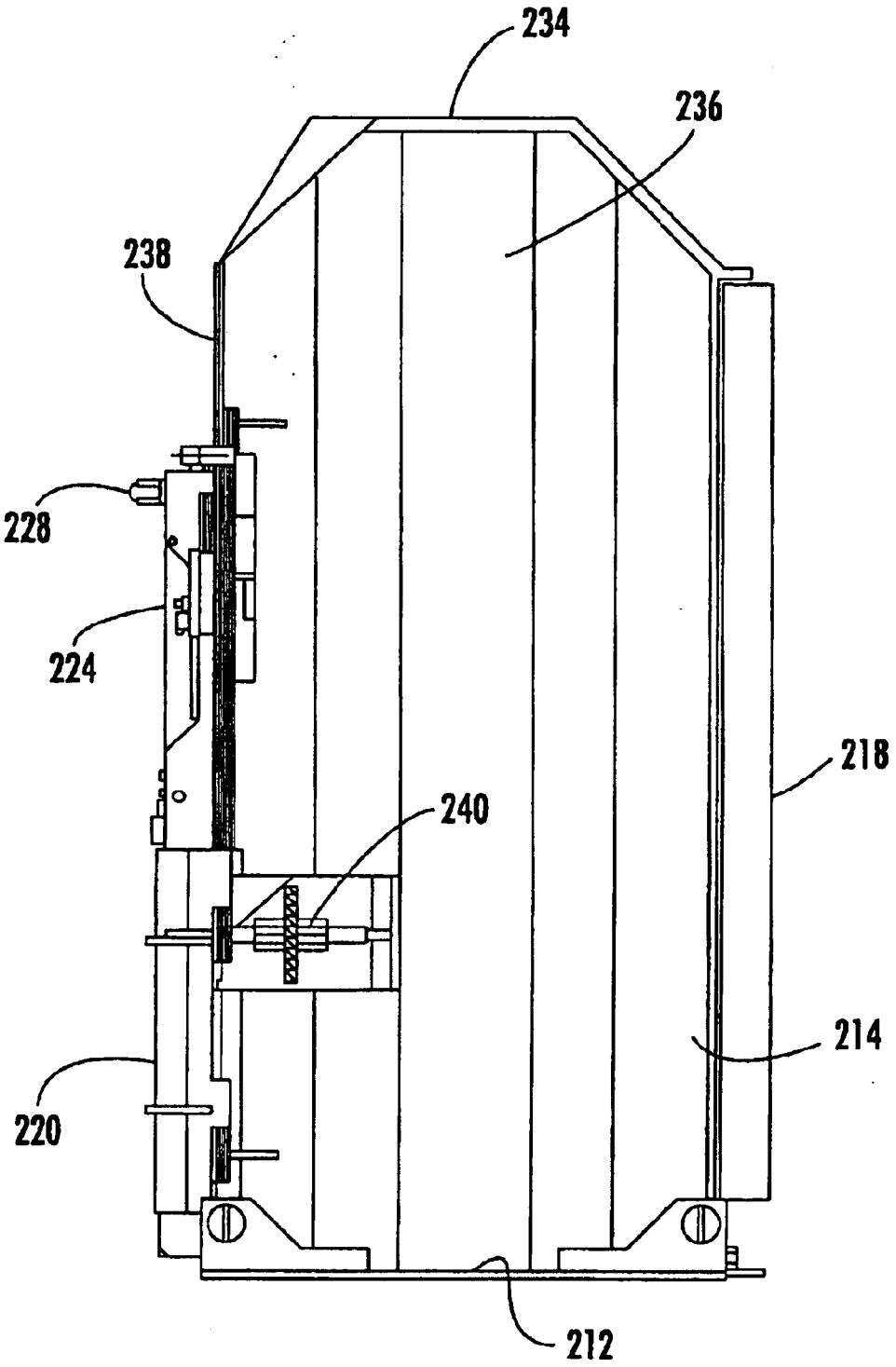

First noting FIGS. 15A–D, the compacting and baling apparatus, referred to generally by the reference numeral 210, includes a base 212 adapted to rest upon a support surface such as floor 213. The apparatus 210 includes wall means fixed laterally to the base so as to define a compacting chamber 230 above the base 212; an upper portion 232 of the compacting chamber 230 is adapted for communication with a loading ingress, described below, in order that materials to be compacted can be inserted into the compacting chamber 230. The wall means includes opposing first and second walls 214, 216 each of which is fitted to and extends generally normal to the base 212 to an upper side wall extremity, and a rear wall 218 which is fitted to and also extends generally normal to the base 212 and between the first and second walls 214, 216. The compacting chamber 230 is further defined by a front wall in the form of a door 220 which, when in a closed position, extends normal to the base and between the side walls. The door 220 is rotatably attached via hinges 223 to one of the side walls, for example, side wall 216 as shown in FIG. 15A.

The door 220 is provided with an upper frame member 222 into which is fitted a loading gate 224 which is hinged within the frame along hinge line 226, in order that the gate may be operated by handle 228 between a closed position with the gate 224 generally parallel with the door 220 and an open position where the gate is extending generally normal to the door.

The apparatus 210 further comprises a reciprocating compression assembly, referred to generally with reference numeral 242, located within the compacting chamber 230 and adapted to reciprocate up and down within the chamber in order to compress and compact articles which are loaded into the apparatus 210 via the loading gate 224. The details of the reciprocating compression assembly 242 will be described hereafter with reference to FIGS. 16A–C and 17. The apparatus 210 also comprises a floor plate assembly, referred to generally in FIG. 15A by reference numeral 284, which is described in greater detail below with reference to FIGS. 18, 19A and 19B, and 20A–D.

With continuing reference to FIGS. 15A–D, the apparatus 210 includes restricting tabs along the inside surfaces of the rear wall and the door 220 including restricting tabs 221 specifically shown in FIG. 15A. In the same manner as the arrangement shown in FIGS. 1–14, the apparatus 210 also includes a security key system 235, a door and loading gate closure sensors 237, 239, a controller (not shown in FIG. 15A) and a full chamber sensor (also not shown).

In order to facilitate safety considerations for a baler like that shown in FIGS. 114, the apparatus 210 is provided with a top enclosure panel 234, side enclosure panels 236 and a front enclosure panel 238, which are all designed to protect operators from accidental injury during the operation of the apparatus. It will particularly be appreciated by those skilled in the art that the side panels 236 extend to the upper extremity of the first and second side walls 214, 216 in order to protect a person from injury during the operation of the piston assemblies 30, 32 shown variously above in FIGS. 1–14. The side covers 236 do so in a facile manner, since the particular configuration of the piston assemblies is within the vertical extremity of the side walls 214, 216 and between the corresponding side wall and adjacent side cover 236.

The details of the reciprocating compression assembly 242 will now be described with reference to FIG. 16A–C and 17. Like the compression assembly arrangement shown in FIG. 3, the assembly 242 as shown in FIGS. 16A–C and 17 comprises an elongated beam section 248 having opposing ends 258, 260, which are adapted to fit within vertical slots in the first and second side walls 214,216. While those vertical slots cannot be seen in the view of FIGS. 15A–D, similar slots are depicted as elements 53 and 55 in FIG. 3. The compression assembly 242 also includes vertically-extending support member sections 250 which serve a purpose similar to that of vertical support members 96 in FIG. 3. However, in the arrangement of the reciprocal compression assembly 242 shown in FIGS. 16A–C and 17, the elongated beam section 248 and the support member sections 250 are formed from a pair of spaced arch plates 244, 246 joined and extending normal to the outer-facing side of a compression plate member 266. Each of the arch plates 244, 246 extend to the respective ends 258, 260 with each support member section 250 terminating in a tab 252 having a shoulder 254 dimensioned to extend within a corresponding slot 253 of a portion of the lower compression plate 264 (note FIG. 17). The pair of arch plates 244, 246 are rigidly held in place via bridging plates 256 which are joined via tabs and corresponding slots 257 to the pair of arch plates 244, 246.

Figure 16A:
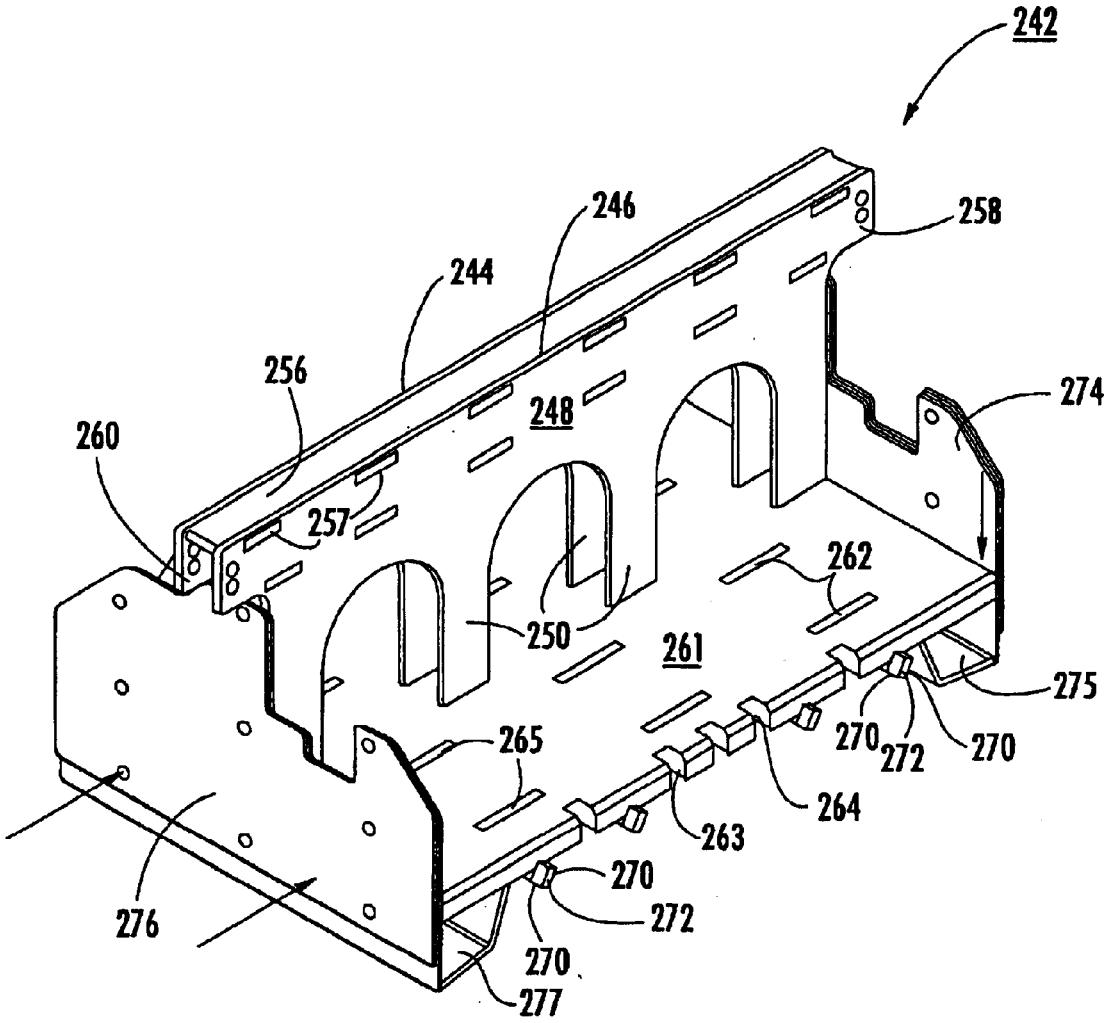
FIGS. 16A, 16B and 16C are top perspective, front and bottom perspective views, respectively, of a compression assembly construction for the embodiment depicted in FIGS. 15A–15D.
Figure 16B:
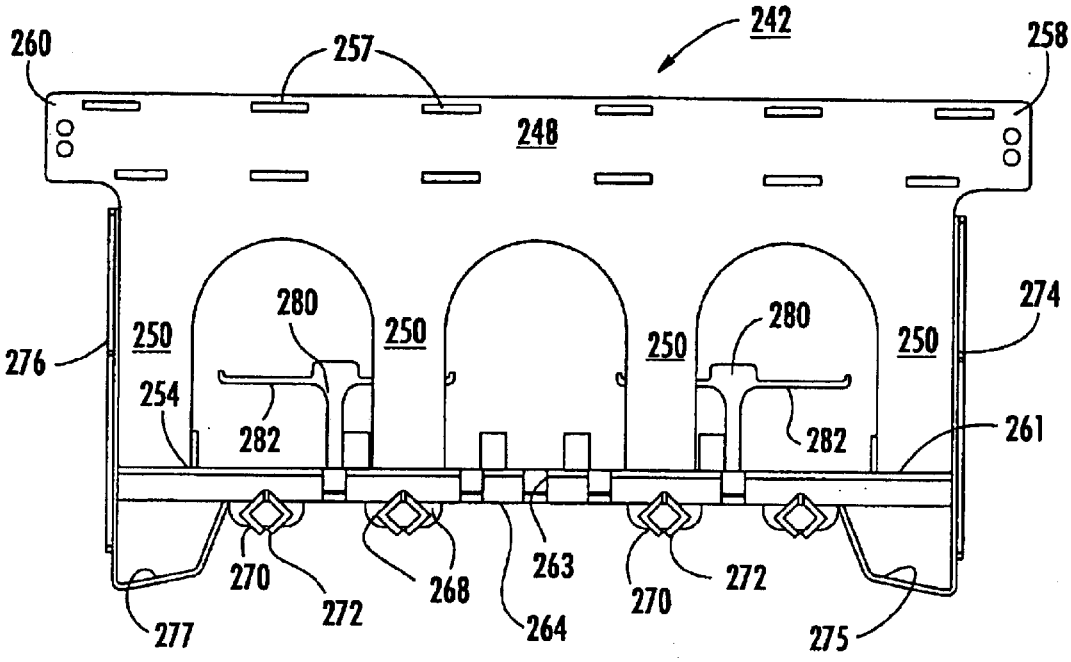
Figure 16C:
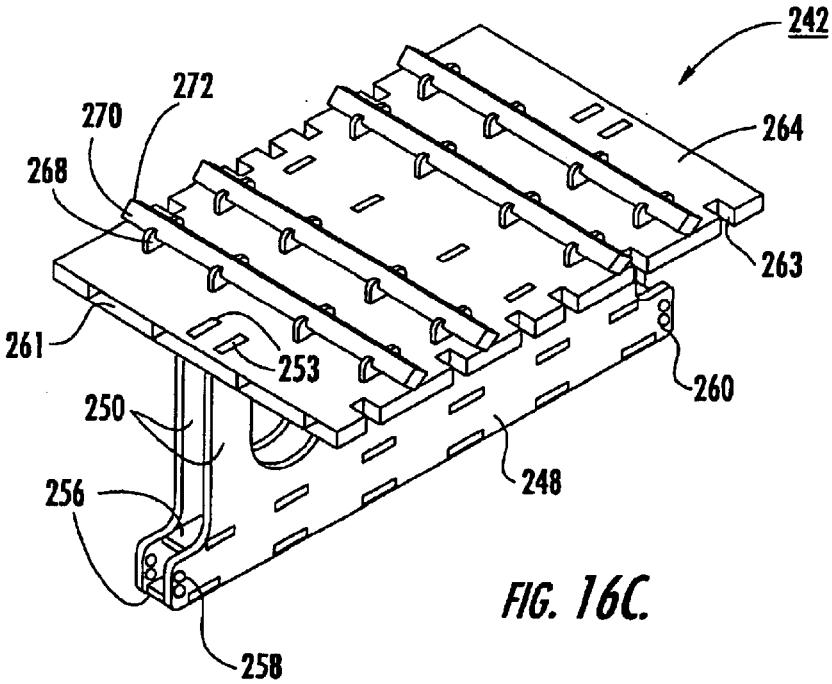
Figure 17:
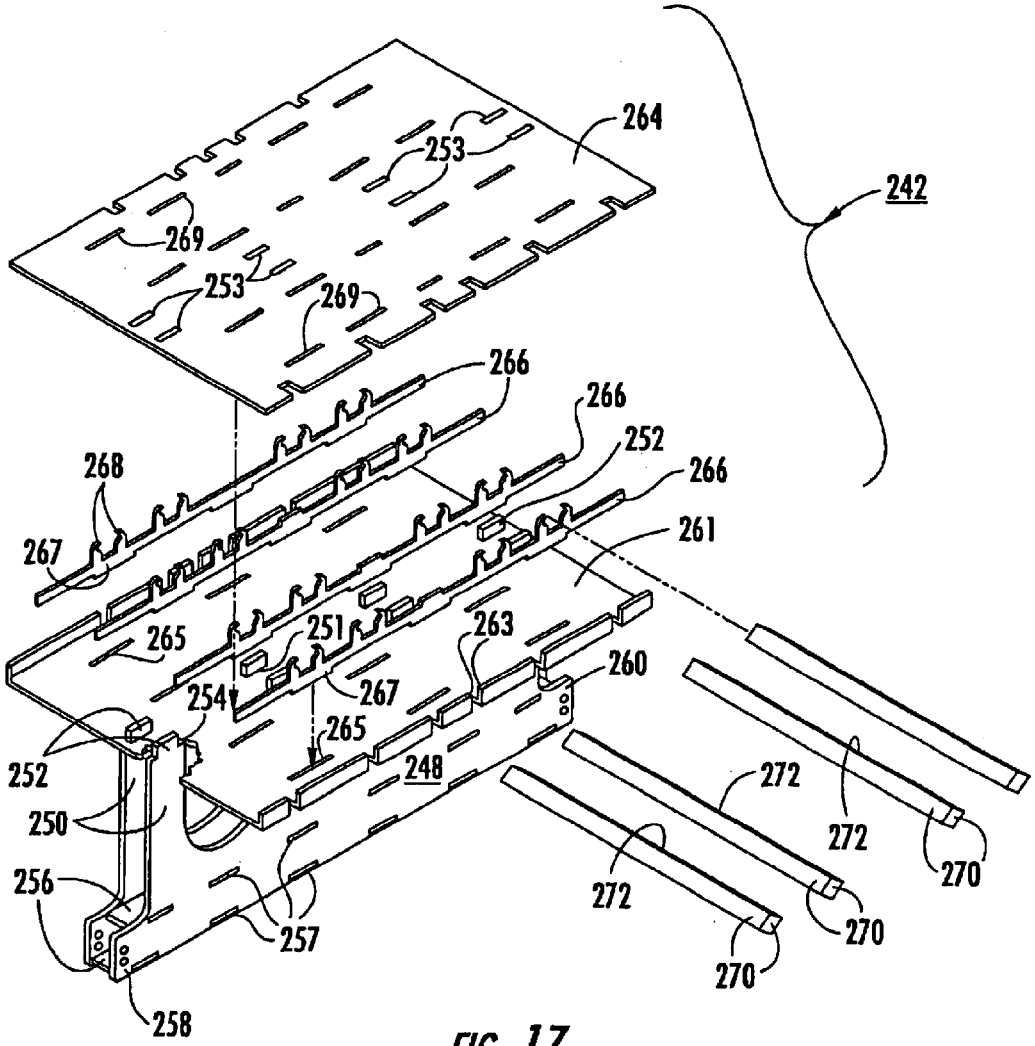
FIG. 17 is an exploded perspective view of the compression assembly shown in FIGS. 16A–C.

With continued reference to FIGS. 16A–C and 17, the compression plate assembly 242 includes an upper, outwardly-facing plate 261 and an inwardly-facing lower plate 264, each of the upper and lower plates 261, 264 being generally spaced and parallel from each other within the compacting chamber 230 and provided with plural slots 263 adapted to mate with the restriction tabs 221 (FIG. 15A) in order that the restricting tabs do not interfere with the reciprocation of the compression plate member 266 as it is moved upwardly and downwardly within the compacting chamber 230. With particular reference to the exploded view of FIG. 17, the compression plate member 266 portion of the reciprocating compression assembly 242 is provided with slots 251 (upper plate 261) and slots 253 (lower plate 264) for receiving the tabs of arch support plates 244, 246. Similarly, upper and lower plates 261, 264 are provided with additional, respective slots 265, 269 for receiving intermediate strut members 266, each of which has spaced pairs of retainers 268 which extend through slots 269 and into the compacting chamber 230. Opposing pairs of strap retaining members 270 are inserted laterally across lower plate 264 and through corresponding pairs of retainers 268. Each pair of strap retaining members defines an elongated opening 272. When fitted together in the manner depicted in FIG. 16A–C, the strap retaining members 270 permit strapping to be inserted therein and out of the openings 272 in order to wrap a bale of compacted articles in a facile manner. As shown in FIG. 16B, strap spools 280 with spool supporting arms 282 may be fitted to the compression plate assembly 242. Friction pads 274, 276 serve the same purpose as pads 99 in FIG. 13A.

Figure 18:
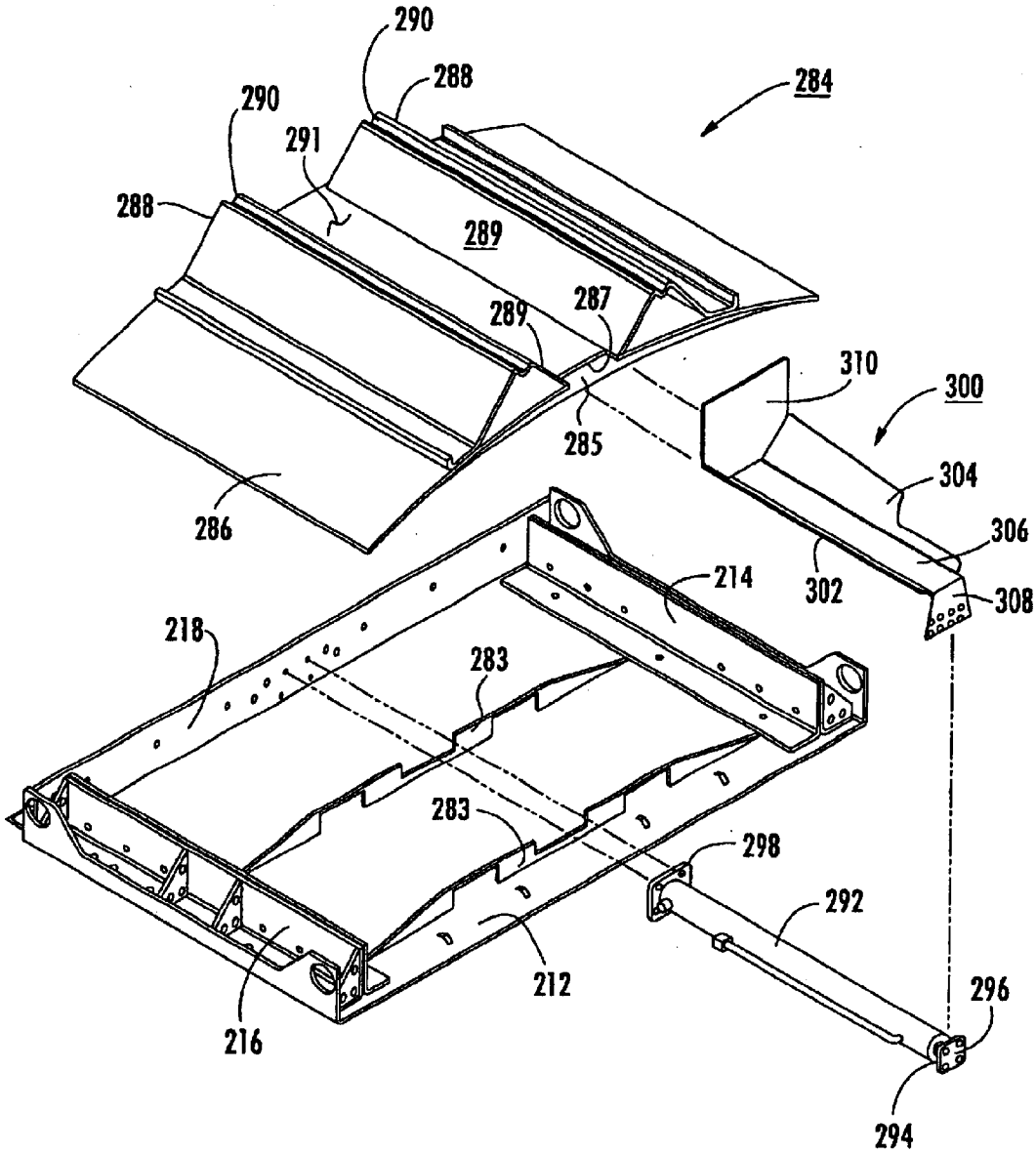
FIG. 18 is an exploded perspective view of an alternate arched floor and ejector tray assembly.
Figure 19A:
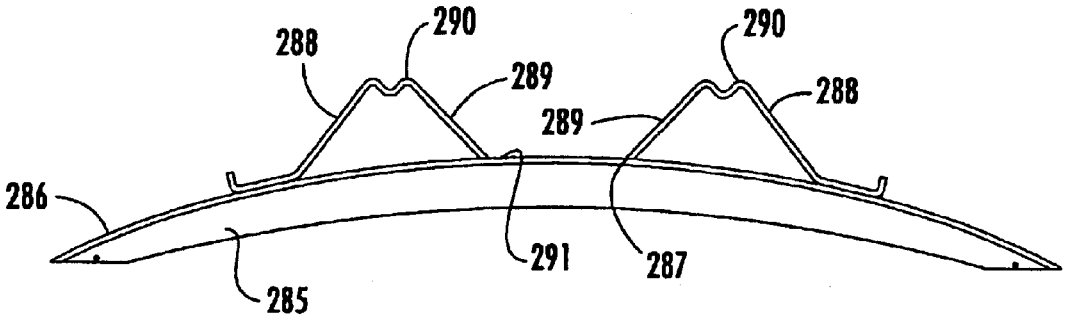
FIGS. 19A and 19B are front and top views, respectively, of the arched floor and ejector tray construction shown in FIG. 18.
Figure 19B:
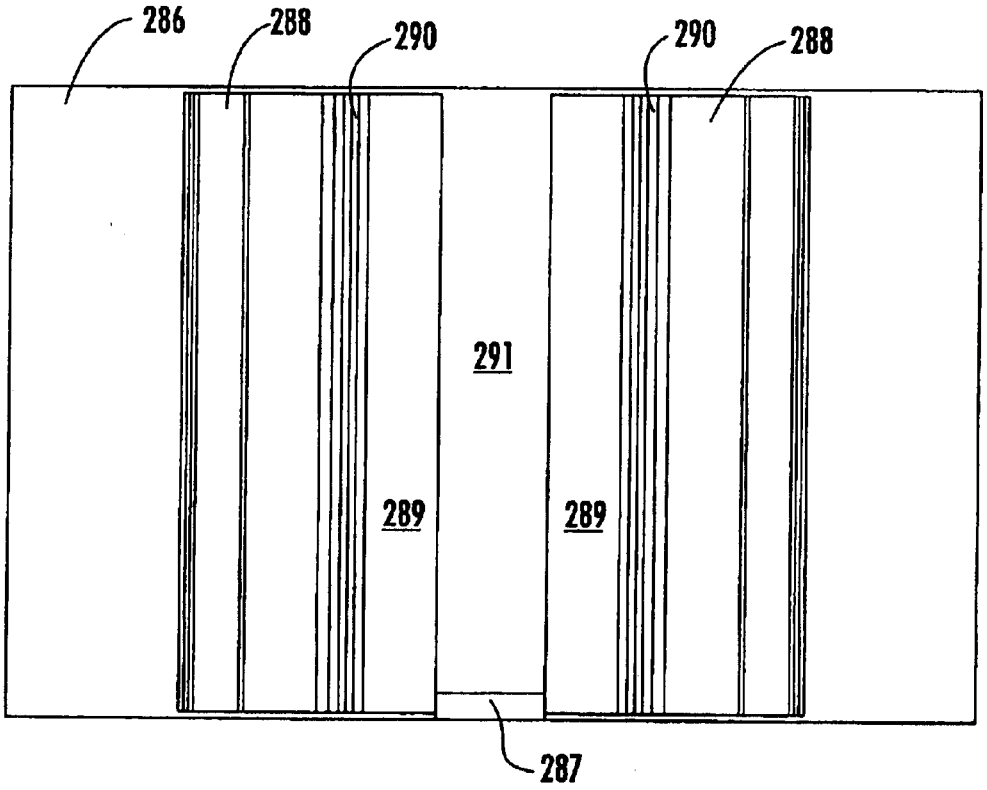
Figure 20A:
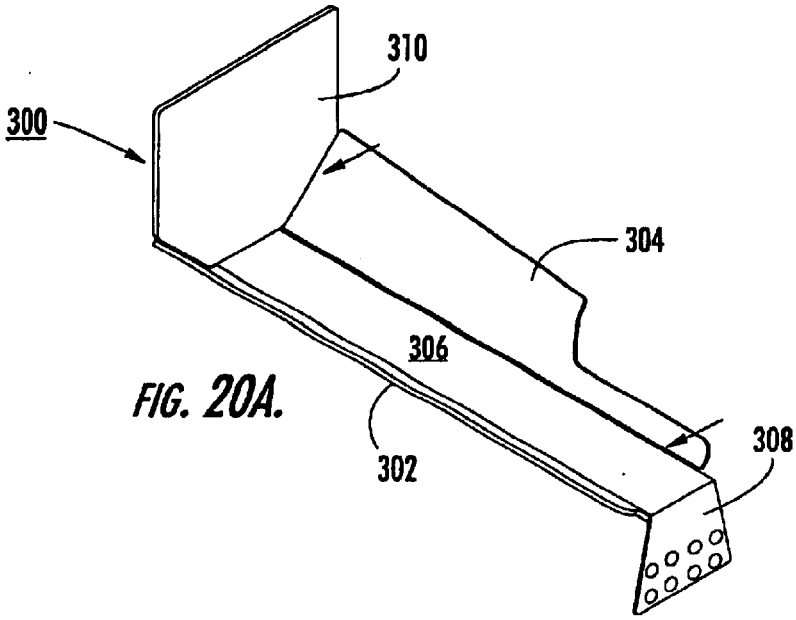
FIGS. 20A, 20B, 20C and 20D are perspective, top, side and front views, respectively, of the construction for the ejector tray shown in FIG. 18.
Figure 20B:
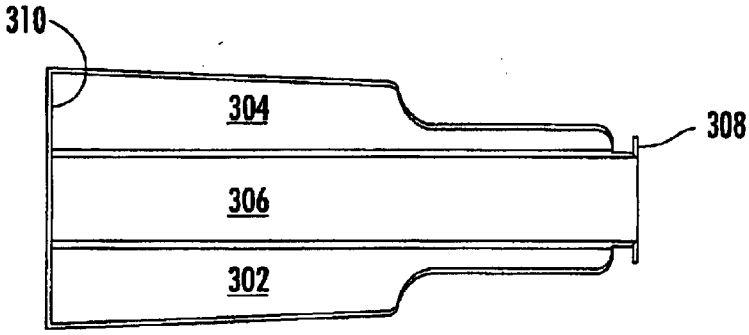
Figure 20C:
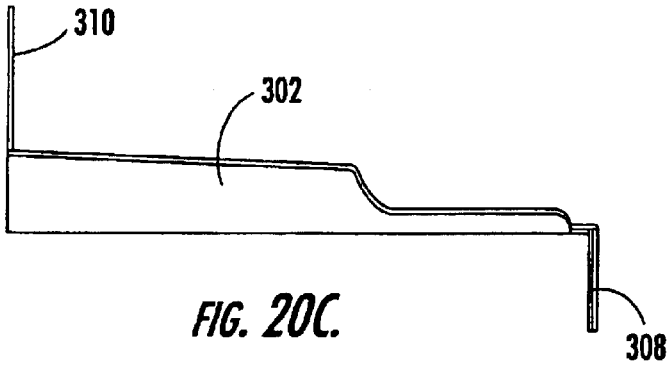
Figure 20D:
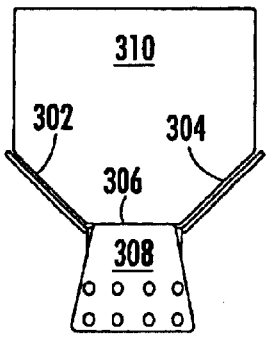

The floor plate assembly 284 will now be described with reference to FIGS. 18, 19A and B, and 20A–D. The floor plate assembly 284 includes a floor plate 286 arched in a manner which creates a greater dimension between the floor 286 and the base 212 at a central portion of the compacting chamber 230. The arched form of the floor 286 is rigidly maintained by arched ribs 285 and 283. In the manner described above with reference to the construction of FIGS. 1–14, the floor plate assembly 284 includes means for forming depressions in the bottom of the compacted articles in order to facilitate lifting. To this end, a pair of spaced depression members 288 are rigidly fixed to the upper surface of the arched floor 286. Preferably, the depression members 288 have a cross-sectional shape such as the triangular configuration shown in FIG. 18, or some other configuration that provides a wider area near the bottom than the top of the depression formed by the member. Each depression member has a longitudal groove 290 into which strapping may be extended from the rear wall 218 toward the door 220 when the apparatus 210 is in use. Each depression member 288 is provided with an inner sloping side wall 289 with the slope of these side walls and the dimension between the pairs of depression members 288 being such as to slidably receive in close contact an ejection tray member 300. The ejection tray member 300 includes opposing angled side walls 302, 304 and an intermediate flat portion 306 which are collectively dimensioned to fit in good sliding relationship with the flat surface 291 between the depression members 288 and the corresponding side walls 289. The floor plate assembly 284 further includes a reciprocating piston 292 having a rearward end 298 which is fitted on an inside surface of the rear wall 218, and a piston 294 the forward end 296 of which is bolted to the inside surface of a plate 308 extending downwardly from flat portion 306 of ejector tray 300. The ejector tray 300 further includes an upwardly extending back plate for facilitating ejection of a compacted bale from the compacting chamber 230 upon actuation of the piston 292.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. Compacting and baling apparatus comprising:

a base adapted to rest upon a support surface and wall means fixed laterally to the base, the wall means and the base defining a compacting chamber above the base;

the wall means including opposing first and second side walls each extending generally normal to the base to a side wall extremity, and a rear wall extending generally normal to the base and between the first and second side walls;

the wall means further including a front wall extending normal to the base and between the side walls, with a compacting chamber loading ingress and a compacted bale egress defined by the front wall;

a reciprocating compression assembly including (a) a compression plate member within the compacting chamber, the compression plate member disposed generally parallel to the base and having an inner side facing into the compacting chamber and an outer side opposite the inner side;

(b) an elongated compression beam extending generally parallel with the base and having a first end extending through a first elongated slot in one of the side walls and a second end extending through a second elongated slot in the other side wall;

(c) means for rigidly coupling the compression plate member with the elongated compression beam for movement therewith; and (d) first and second piston assemblies each extending generally normal to the base and fixed at one end adjacent the base and at a second end to one of the ends of the elongated compression beam;

compression means fitted between the base and the side wall extremities for forcing the compression plate member toward the base in order to compact articles placed in the compacting chamber, to form a bale of the compacted articles;

means for applying strapping to a compacted bale while in the compacting chamber; and means for ejecting a strapped, compacted bale out of the bale egress.

2. The compacting and baling apparatus recited in claim 1, wherein the compression means comprises first and second piston assemblies, each extending generally normal to the base and parallel with, and outside of a corresponding one of the first and second side walls, each piston assembly fixed at one end adjacent the base and at a second end to the compression assembly.

3. The compacting and baling apparatus recited in claim 2, further comprising first and second side panels extending generally normal to the base and parallel with a corresponding one of the first and second side walls, with a corresponding one of the first and second piston assemblies fitted between the respective side wall and side panel.

4. The compacting and baling apparatus recited in claim 1, wherein the front wall further comprises a door rotatably hinged to one of the side walls for opening and closing rotation about an axis extending generally normal to the base, the door forming the compacted bale egress when in an open position.

5. The compacting and baling apparatus recited in claim 4, further comprising latch means along the door and the other side wall for latching the door into a closed position.

6. The compacting and baling apparatus recited in claim 5, further comprising sensing means along the other side wall for sensing whether the door is in the closed position.

7. The compacting and baling apparatus recited in claim 6, further comprising a loading gate pivotably hinged in the door at an upper location thereon spaced from the base, the gate forming the loading ingress when the compression assembly is in the retracted position whereby articles to be compacted may be inserted through the ingress and into the compacting chamber while the door is in the closed position.

8. The compacting and baling apparatus recited in claim 7, wherein the loading gate is pivotably hinged about an axis which is generally parallel with and spaced from the base, the loading gate rotatable between a closed position generally in the same plane with the door and an open position generally normal to the door.

9. The compacting and baling apparatus recited in claim 8, wherein the sensing means further senses when the loading gate is in the closed position.

10. The compacting and baling apparatus recited in claim 9, further comprising controller means for preventing operation of the compression means unless both the door and the loading gate are in their respective closed positions.

11. The compacting and baling apparatus recited in claim 10, further comprising:

means for sensing when the compacting chamber is full; and the controller means including means for preventing operation of the compression means unless the compacting chamber is sensed as full.

12. The compacting and baling apparatus according to claim 11, further comprising means for restricting operation of the compression means until after the door and the loading gate are in their respective closed positions, the compacting chamber is full and a security key is inserted into an assembly electronically coupled with the controller means.

13. The compacting and baling apparatus recited in claim 1, wherein the first and second elongated slots extend generally normal to the base.

14. The compacting and baling apparatus recited in claim 1, wherein the rigidly coupling means comprises support member means extending between and coupled with the elongated compression beam and the compression plate member.

15. The compacting and baling apparatus recited in claim 14, wherein the elongated compression beam and the support member means comprises:

a pair of spaced plates joined and extending generally normal to the outer side of the compression plate member, each of the pair of plates having an upper, elongated section including the first and second ends extending through the respective first and second slots in the side walls and a support member section between the elongated section and the outer side of the compression plate member; and a pair of spaced bridging plates extending between the pair of plates.

16. The compacting and baling apparatus recited in claim 15, further comprising:

the compression plate member comprising a pair of spaced plates, including a first, lower plate defining the inner side and a second, upper plate defining the outer side; and wherein the plates include plural tabs at extremities of the support member portions thereof, each tab extending through a tab slot in the upper plate and in contact with the lower plate to impart strength and rigidity for the compression plate member.

17. The compacting and baling apparatus recited in claim 16, wherein each support member tab is defined by shoulders engaging the outer side of the upper plate.

18. The compacting and baling apparatus recited in claim 16, further comprising:

the lower plate having plural strut slots therein;

plural strut members fitted into engagement with, and between the upper and lower plates, each strut member extending generally parallel with the base and having plural pairs of spaced, opposed retainers dimensioned to extend through the strut slots in the lower plate and beyond the inner side;

pairs of the retainers in each strut being aligned with retainers in other struts; and plural strap retainers, each strap retainer fitted across the inner side of the lower plate between the front and rear walls, each strap retainer including an elongated opening therein for permitting the release of strapping extending therethrough.

19. The compacting and baling apparatus recited in claim 1, further comprising:

a floor plate assembly including a floor plate positioned in the compacting chamber adjacent the base and opposite the compression plate member for supporting the articles during compacting.

20. The compacting and baling apparatus recited in claim 19, wherein the floor plate is arched across the compacting chamber between the side walls, with a greatest distance between the arch and the base being centrally located in the compacting chamber.

21. The compacting and baling apparatus recited in claim 20, further comprising plural floor plate arch supports between the floor plate and the base and extending between the side walls.

22. The compacting and baling apparatus recited in claim 19, further comprising at least one depression member fitted to a surface of the floor plate facing the compression plate member and extending from adjacent the rear wall toward the front wall, the depression member adapted to form a depression in the bottom of a compacted bale to facilitate lifting of the bale.

23. The compacting and baling apparatus recited in claim 22, wherein the depression member includes an elongated groove extending from adjacent the rear wall toward the front wall, the groove dimensioned to receive strapping therein.

24. The compacting and baling apparatus recited in claim 19, wherein the floor plate comprises:

a plurality of overlapping floor sections extending between the side walls; and means for sliding the floor sections in a direction from the rear wall toward the baling egress.

25. The compacting and baling apparatus recited in claim 19, wherein the ejecting means comprises an ejection piston assembly fitted between the base and floor plate, and extending in a direction between the rear and front walls.

26. The compacting and baling apparatus recited in claim 25, wherein the ejecting means further comprises means with the floor plate for engaging a side of the compacted bale adjacent the rear wall and pushing the bale toward the bale egress during operation of the ejection piston assembly.

27. The compacting and baling apparatus recited in claim 26, wherein the bale engaging and pushing means comprises pusher tabs attached to and extending away from the floor plate.

28. The compacting and baling apparatus recited in claim 26, wherein the bale engaging and pushing means comprises:

a pusher tray slidably fitted across a top surface of the floor plate; and means for sliding the pusher tray toward the baler egress responsive to operation of the ejection piston assembly.

29. The compacting and baling apparatus recited in claim 28, further comprising:

a pair of depression members fitted to a top surface of the floor plate facing the compression plate member, each depression member extending from adjacent the rear wall toward the front wall and adapted to form a depression in the bottom of a compacted bale to facilitate lifting; and wherein the pusher tray is shaped and dimensioned to slide across the surface of the floor plate between the pair of depression members.

30. The compacting and baling apparatus recited in claim 28, wherein the pusher tray includes an upwardly-extending tab portion for engaging and pushing the rear side of the compacted bale.

31. The compacting and baling apparatus recited in claim 1, further comprising strapping spool support means carried by the apparatus.

32. The compacting and baling apparatus recited in claim 31, further comprising strapping feed openings in the rear wall.

33. Apparatus for compacting articles and adapted for use indoors within small floor and vertical spaces, comprising:

an enclosure including a base adapted to rest upon a support surface and wall means fixed laterally to the base, the wall means and the base defining a compacting chamber above the base;

the wall means including opposing first and second side walls each extending generally normal to the base to a side wall extremity, and a rear wall extending generally normal to the base and between the first and second side walls;

the wall means further including a front wall extending normal to the base and between the side walls with a compacted material egress defined by the front wall;

a reciprocating compression assembly including (a) an elongated beam section having first and second ends each of which extends through an elongated slot in a corresponding one of the first and second side walls;

(b) a compression plate member within the compacting chamber and mechanically coupled for reciprocating movement in the compacting chamber with the elongated beam;

(c) means for rigidly coupling the compression plate member with the elongated compression beam for movement therewith; and (d) first and second piston assemblies each extending generally normal to the base and fixed at one end adjacent the base and at a second end to one of the ends of the elongated compression beam;

first and second elongated piston assemblies within the enclosure, each of the piston assemblies extending along a corresponding one of the first and second side walls and fixed at one end adjacent the base and at the other end to a corresponding end of the elongated beam; and means for ejecting compacted articles through the egress in a direction laterally away from the rear wall.

34. The apparatus recited in claim 33, further comprising means within the enclosure for forming depressions in a bale of compacted articles, the depressions facilitating lifting of a bale with a forklift.

* * * * *